US008246117B2

(12) United States Patent
Melhuish et al.

(10) Patent No.: US 8,246,117 B2
(45) Date of Patent: Aug. 21, 2012

(54) ARMREST APPARATUS

(75) Inventors: Robert A. Melhuish, East Greenville, PA (US); Gregory Allison, Orefield, PA (US)

(73) Assignee: Knoll, Inc., East Greenville, PA (US)

( * ) Notice: Subject to any disclaimer, the term of this patent is extended or adjusted under 35 U.S.C. 154(b) by 473 days.

(21) Appl. No.: 12/478,184

(22) Filed: Jun. 4, 2009

(65) Prior Publication Data

US 2009/0302661 A1 Dec. 10, 2009

Related U.S. Application Data

(60) Provisional application No. 61/059,297, filed on Jun. 6, 2008.

(51) Int. Cl.
*A47C 7/54* (2006.01)

(52) U.S. Cl. ..... 297/411.35; 297/411.37

(58) Field of Classification Search ..... 297/411.35, 297/411.37

See application file for complete search history.

(56) References Cited

U.S. PATENT DOCUMENTS

| | | | |
|---|---|---|---|
| 4,961,610 | A | 10/1990 | Reeder et al. |
| 5,056,863 | A | 10/1991 | DeKraker et al. |
| 5,188,423 | A | 2/1993 | Meiller et al. |
| 5,265,938 | A | 11/1993 | Melhuish et al. |
| 5,393,124 | A | 2/1995 | Neil |
| 5,415,459 | A | 5/1995 | Schultz |
| 5,439,267 | A | 8/1995 | Peterson et al. |
| 5,484,187 | A | 1/1996 | Doerner et al. |
| 5,597,208 | A | 1/1997 | Bonutti |
| 5,599,067 | A | 2/1997 | Schuelke et al. |
| 5,676,483 | A | 10/1997 | Koubek |
| 5,876,097 | A | 3/1999 | Cao |
| 5,971,484 | A | 10/1999 | Lamart et al. |
| 5,975,640 | A | 11/1999 | Chen |
| 6,017,091 | A | 1/2000 | Cao |
| 6,540,300 | B2 | 4/2003 | Piretti |

(Continued)

FOREIGN PATENT DOCUMENTS

WO WO 2008/041868 A2 4/2008

(Continued)

OTHER PUBLICATIONS

PCT International Search Report, dated Oct. 5, 2009.

(Continued)

*Primary Examiner* — Anthony D Barfield

(74) *Attorney, Agent, or Firm* — Buchanan Ingersoll & Rooney PC

(57) ABSTRACT

An armrest apparatus and chair including one or more armrest apparatuses are disclosed. Each armrest apparatus includes an armrest member attached to at least one chair component. The armrest member has a first aperture and a second aperture. A first plate is positioned above the armrest member. The first plate has a longitudinal slot that is transverse to the first and second apertures. An armrest cover is attached to the first plate. A resilient device is positioned between the first plate and the armrest cover or between the first plate and the armrest member. The resilient device has a first hole sized and configured to receive the first member and a second hole sized and configured to receive the second member. A first member extends through the first aperture, first hole and the longitudinal slot and a second member extends through the second aperture, second hole and the longitudinal slot.

25 Claims, 18 Drawing Sheets

U.S. PATENT DOCUMENTS

| | | | | |
|---|---|---|---|---|
| 6,659,561 | B1 | 12/2003 | Lee | |
| 6,802,566 | B2 | 10/2004 | Prince et al. | |
| 6,840,582 | B2 | 1/2005 | Burwell et al. | |
| 7,234,779 | B2 | 6/2007 | Bedford et al. | |
| 7,533,939 | B2 * | 5/2009 | Fookes et al. | 297/411.36 X |
| 2005/0146192 | A1 | 7/2005 | Trego et al. | |
| 2006/0250018 | A1 | 11/2006 | Tsai | |

FOREIGN PATENT DOCUMENTS

| | | | |
|---|---|---|---|
| WO | WO 2008/112920 | A1 | 9/2008 |

OTHER PUBLICATIONS

U.S. Appl. No. 60/953,213, filed Aug. 1, 2007, Machael.

* cited by examiner

ARMREST APPARATUS

CROSS-REFERENCE TO RELATED APPLICATION

The present application claims the benefit under 35 U.S.C. §119(e) of pending U.S. Provisional Patent Application Ser. No. 61/059,297, which was filed on Jun. 6, 2008. The entirety of U.S. Provisional Patent Application Ser. No. 61/059,297 is incorporated herein by reference.

FIELD OF THE INVENTION

The present invention relates to chairs, particularly armrest devices for chairs.

BACKGROUND OF THE INVENTION

Adjustable armrests are disclosed in U.S. Pat. Nos. 7,234,779, 6,840,582, 6,802,566, 6,659,561, 6,540,300, 5,975,640, 5,971,484, 5,876,097, 5,676,483, 5,599,067, 5,597,208, 5,484,187, 5,439,267, 5,415,459, 5,393,124, 5,265,938, 5,188,423, 5,056,863, and 4,961,610, U.S. Provisional Patent Application No. 60/953,213 and World Intellectual Property Organization Publication No. WO2008/112920. Such armrests typically permit a user to adjust an armrest laterally, rotationally, or longitudinally so the user may adjust the support provided to his arms when in a particular seated position.

The armrests may also be attached to a support that permits vertical adjustment of the armrests. For example, armrests may be supported on a tube that extends out of a support attached to a chair seat or chair base. As another example, the armrests may be attached to back frame side members such that the armrests are vertically moveable along the side members.

One problem many users experience with adjustable armrest designs is their inability to provide a sufficiently stable position. For instance, in some adjustable armrest designs, a user may freely move an armrest to a desired position. However, when a user may lean on the armrest, that armrest may move to an undesired position due to the force exerted on the armrest by the user.

Some armrest designs utilize a locking mechanism to address the issue of free moving armrest designs. For instance, the armrest design disclosed in World Intellectual Property Organization Publication No. WO2008/112920 utilizes a locking mechanism that locks the position of an armrest in a particular position. For a user to move the armrest, the user actuates the locking device to unlock the position of the armrest prior to adjusting the position of the armrest. The adjustment of such locking devices to an unlocked position can prevent a user from readily and easily adjusting the position of an armrest. For instance, such locking mechanisms often require a relatively high amount of force to press a button or actuate a lever to unlock the locking device prior to adjusting the position of the armrest.

An adjustable armrest device is needed that permits the adjustment of an armrest without the use of a locking device that requires the locking device to be placed in an unlocked position prior to adjusting the position of an armrest. Preferably, the adjustable armrest device will not require such a locking device for any rotational, longitudinal or lateral adjustment of the armrest. Such an armrest is also preferably configured to maintain its position when a user leans on the armrest while also permitting relatively easy adjustment of the armrest.

SUMMARY OF THE INVENTION

A chair is disclosed that includes a base, a seat attached to the base and a back attached to at least one of the seat and the base. At least one armrest apparatus is attached to at least one of the back, seat and base. Each of the armrest apparatuses includes an armrest member, a first plate positioned above the armrest member, an armrest cover attached to the first plate, and a resilient device positioned between the armrest member and the first plate or the first plate and the armrest cover. The armrest member has a first aperture and a second aperture. At least a portion of the first aperture is substantially parallel to at least a portion of the second aperture. The first plate has a longitudinal slot that is transverse to the first and second apertures. The resilient device has a first hole and a second hole. A first member and a second member are also included in each armrest apparatus. The first member at least partially extends through the first aperture, the longitudinal slot and the first hole and the second member extends at least partially through the first aperture, the longitudinal slot and the second hole.

In some embodiments of our chair, the first member may extend through the first hole and partially extend through the longitudinal slot and the first aperture and the second member may extend through the second hole and partially extend through the longitudinal slot and the second aperture. In other embodiments, the first member may extend through the first aperture and the longitudinal slot and partially extend through the first hole and the second member may extend through the second aperture and the longitudinal slot and partially extend through the second hole.

Preferably, the longitudinal slot is parallel to at least a portion of the first aperture and the second aperture. Of course, the longitudinal slot may be oriented to cross the first and second aperture in other transverse arrangements.

Embodiments of our chair may include a resilient device that is comprised of a leaf spring positioned above a tapped plate. The leaf spring has a first hole and a second hole. The first hole of the leaf spring may be the first hole of the resilient device and the second hole of the leaf spring may be the second hole of the resilient device. The tapped plate may include a first hole aligned with the first hole of the leaf spring and a second hole aligned with the second hole of the leaf spring. The first member extends through the first hole of the leaf spring and the first hole of the tapped plate. The second member extends through the second hole of the leaf spring and the second hole of the tapped plate. The first and second members may be adjustably attached to the tapped plate and leaf spring such that adjustment of the first and second members can loosen or tighten the positioning of the leaf spring relative to the tapped plate.

In some embodiments of our chair, the armrest cover may include an armrest pad attached to a second plate that is attached to the first plate. The armrest pad may include a cushion or other padding and may be configured to have an interference fit with the second plate, be adhered to the second plate or be attached to the second plate using one or more other attachment mechanisms.

Embodiments of our chair may also include one or more support members attached to the bottom portion of the back of the chair. The one or more support members can extend from the bottom portion of the back of the chair to a position adjacent the seat. Each armrest member of each armrest apparatus is preferably movably attached to a respective support member.

A first armrest apparatus, a second armrest apparatus, a first support member and a second support member are included in some embodiments of our chair. The armrest member of the first armrest apparatus is moveably attached to the first support member and the armrest member of the second armrest apparatus is moveably attached to the second support member. The first support member can extend from a bottom portion of the back of the chair to a position adjacent a first side of the chair. The second support member can extend from a bottom portion of the back of the chair to a position adjacent a second side of the chair, which is opposite the first side of the chair.

In some embodiments of our chair, the first support member may be a generally L-shaped member of a generally J-shaped member and the second support member may be a generally L-shaped member or a generally J-shaped member. In other embodiments the first and second support members may be portions of a unitary generally U-shaped support.

Preferably, the one or more armrest apparatuses do not include a locking device that is moveable from a locked position that locks the lateral and rotational position of the armrest cover to an unlocked position that permits the armrest cover to move laterally and or rotationally.

It should be understood that the first plate and armrest cover may be attached together by different attachment mechanisms. For example, the armrest cover and first plate may be attached together by a snap fit attachment mechanism, an interference fit attachment mechanism, or other attachment mechanisms such as, for example, fasteners or adhesives.

In some embodiments, at least one washer guide and/or at least one bumper may be attached to the first member and at least one washer guide and/or at least one bumper may be attached to the second member. Preferably, the first member is a pin or a screw and the second member is a pin or a screw.

It should be appreciated that the at least one armrest apparatus may be configured such that the resilient device and the first plate are configured for substantially lateral movement along a first path defined by the first and second apertures and the first plate is configured for movement along a second path defined by the longitudinal slot for longitudinal movement. Preferably, the first path also defines rotational movement and does not permit substantial longitudinal movement of the resilient device.

An armrest apparatus is also disclosed that is sized and configured for attachment to at least one chair component. The armrest apparatus includes an armrest member that has a first aperture and a second aperture and is sized and configured for attachment to at least one chair component. The armrest apparatus also includes a first plate positioned above the armrest member that includes a longitudinal slot. An armrest cover is attached to the first plate. A resilient device is positioned between the first plate and the armrest cover or between the first plate and the armrest member. The resilient device has a first hole and a second hole. A first member extends through the first aperture, the longitudinal slot and the first hole. A second member extends through the second aperture, the second hole and the longitudinal slot.

In some embodiments of our armrest apparatus, the armrest apparatus may also include an actuation device attached to the armrest member. The actuation device may include an actuator member configured for movement between a first position and a second position, a biasing mechanism that is sized and configured to bias the actuator member to the first position, and an elongated member that is attached to the actuator member such that the elongated member moves when the actuator member moves from the first position to the second position. In one embodiment, the actuation device also includes an engagement member attached to one end of the elongated member, opposite the end of the engagement member attached to the actuator member. The engagement member is attached to the elongated member such that the engagement member retracts within the armrest member when the actuator member is moved from the first position to the second position.

Preferably, the at least one chair component that the armrest member is configured for attachment to is a support member. The support member is preferably attached to a bottom portion of the back frame. Of course, the support member may also be attached to the base of the chair, such as a chair pedestal or chair tilt mechanism portion of a chair base. The support member may also be attached to the seat of the chair. In other embodiments of our armrest apparatus, the armrest member may be configured for attachment to a support member that is a side frame portion of a chair back.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the armrest apparatus and chairs including armrest apparatuses are shown in the accompanying drawings and certain present preferred methods of practicing the same are also illustrated therein, in which.

DESCRIPTION OF PRESENT PREFERRED EMBODIMENTS

Figure 1:
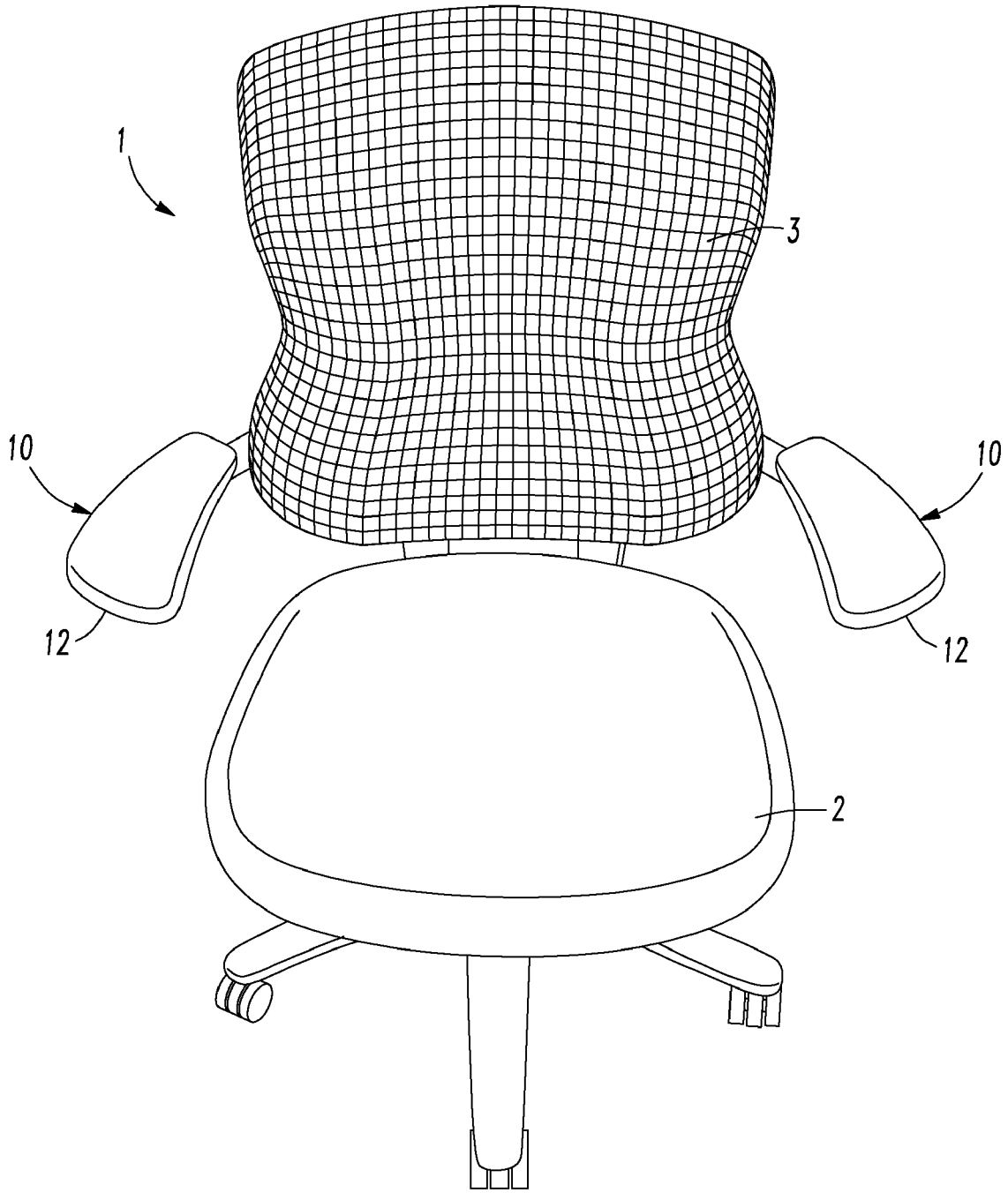
FIG. 1 is a front perspective view of a first present preferred embodiment of our armrest apparatus attached to a chair.
Figure 2:
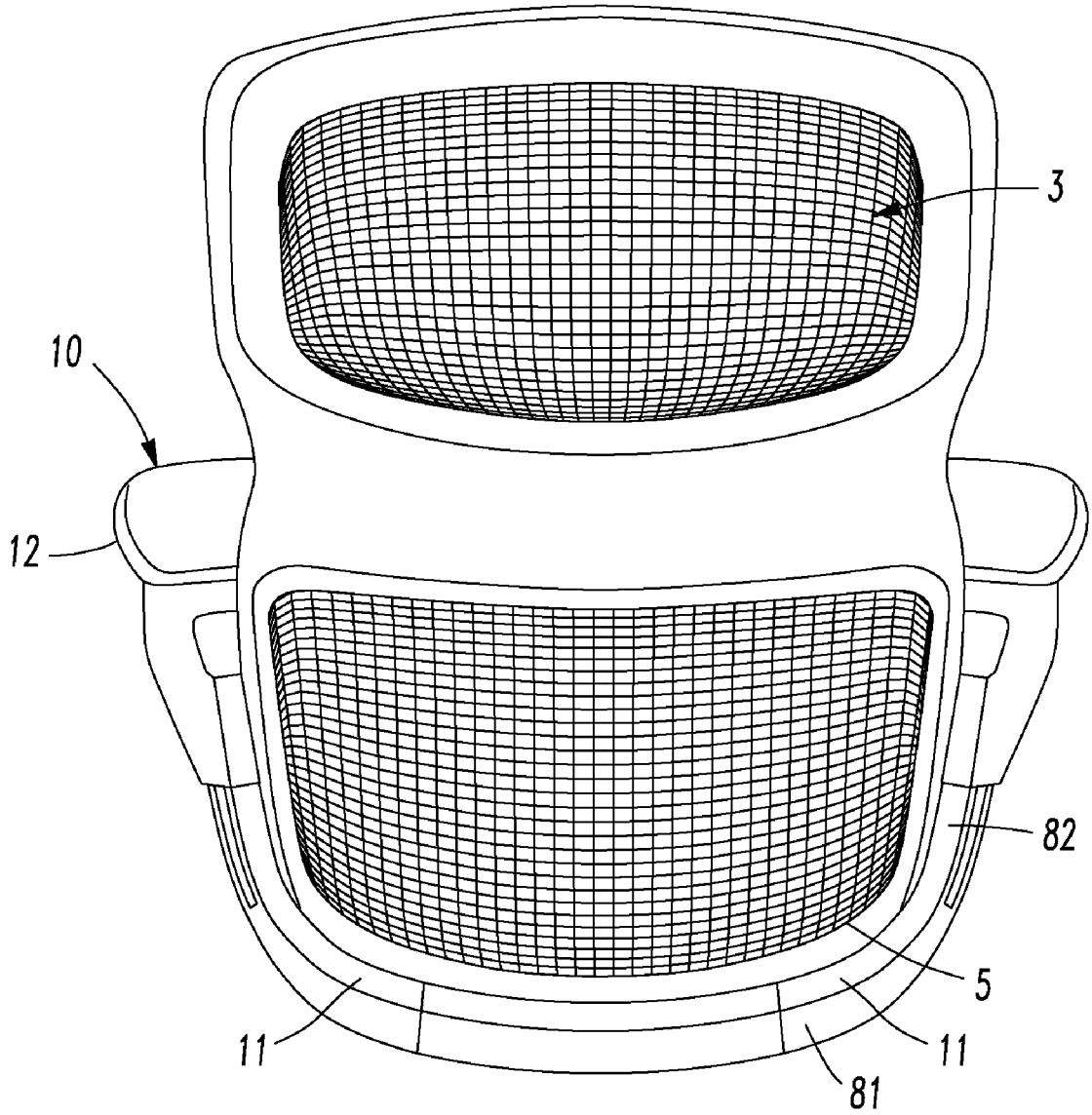
FIG. 2 a back perspective view of the first present preferred embodiment of our armrest attached to a chair.
Figure 3:
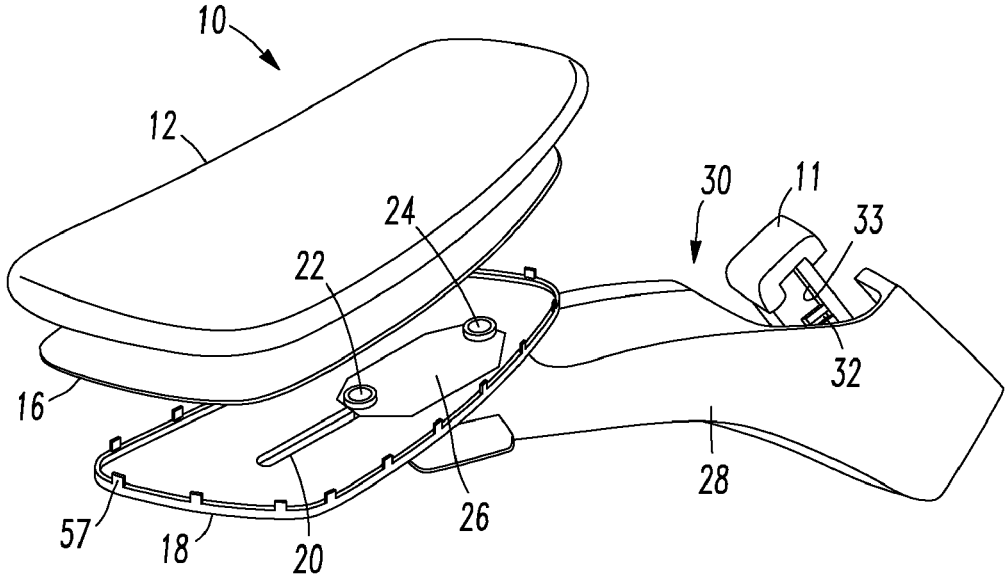
FIG. 3 is an exploded fragmentary view of the first present preferred embodiment.

Referring to FIGS. 1-2, a chair 1 has a seat 2 and a back 3. The back 3 includes a back frame 5 and a skin attached to the back frame. The back skin is configured to be engaged by a user sitting in the chair. An armrest apparatus 10 is positioned adjacent each side of the back 3. Each armrest apparatus 10 includes an armrest support 11 that is attached to the bottom of the back frame 5 and an arm pad 12. The arm pad 12 is connected to the armrest support 11 such that the arm pad 12 may be located at numerous different vertical positions adjacent the seat 2 and the back 3. Each arm pad 12 may be composed of a rigid plastic that provides a surface for supporting an arm or other body part of a user. Of course, the arm pad 12 may alternatively be composed of a fabric covering a cushion, other types of plastic such as soft or flexible plastic, or have other constructions known to those skilled in the art.

As may be seen in FIGS. 3 through 7, the arm pad 12 is attached to an arm pad support plate 16. The arm pad support plate 16 is attached to a plate 18. Preferably, the armrest support plate 16 attaches to the plate 18 such that the support plate 16 snap fits with the plate 18. The support plate 16 may also be attached to the plate 18 by adhesives and/or interconnecting protrusions 57 that interlock with or otherwise fit within holes formed in the support plate 16. Of course, the support plate 16 can also be attached to the plate 18 by other fastening mechanisms.

The plate 18 is attached to an armrest member 28. The armrest member 28 is attached to the armrest support 11 and includes an opening 30 that is sized and configured to receive a portion of the armrest support 11. Preferably, the opening 30 is sized and configured to permit the armrest member 28 to be moved along the armrest support to adjust the vertical position of the armrest member 28 and arm pad 12.

The plate 18 has a slot 20. Pins 22 and 24 extend through the slot 20 and pass through apertures 41 and 43 formed in the armrest member 28. The apertures 41 and 43 are generally transverse to the slot 20. Preferably, the apertures 41 and 43 are substantially perpendicular to slot 20. A resilient body 26 extends from the first pin 22 to the second pin 24. Preferably, the resilient body 26 is a leaf spring. In alternative embodiments, the resilient body 26 may be positioned between the plate 18 and the armrest member 28.

As may be appreciated from FIGS. 8 through 19, the arm pad 12 is moveably connected to the armrest member 28 such that the arm pad 12 is moveable relative to the armrest member to positions that are forward, rearward, inward, or outward from an initial position. The arm pad may be rotatable such that it moves in a generally circular path or an arcuate path or may be slidable such that it moves in a generally linear path. Preferably, the arm pad is moveable so that it is at least rotatable and slidable relative to the armrest member 28.

The extent to which each arm pad 12 may move rearward or forward is defined by slot 20 in the plate 18. The length of the slot 20 defines the path along which pins 22 and 24 may move rearward or forward. The extent to which each arm pad 12 may move inward or outward is defined by the length of the apertures 41 and 43 formed in the armrest member. The pins 22 and 24 move inward and outward along apertures 41 and 43. The extent to which each arm pad is rotatable is defined by the size and configuration of the apertures 41 and 43 and slot 20.

Figure 20:
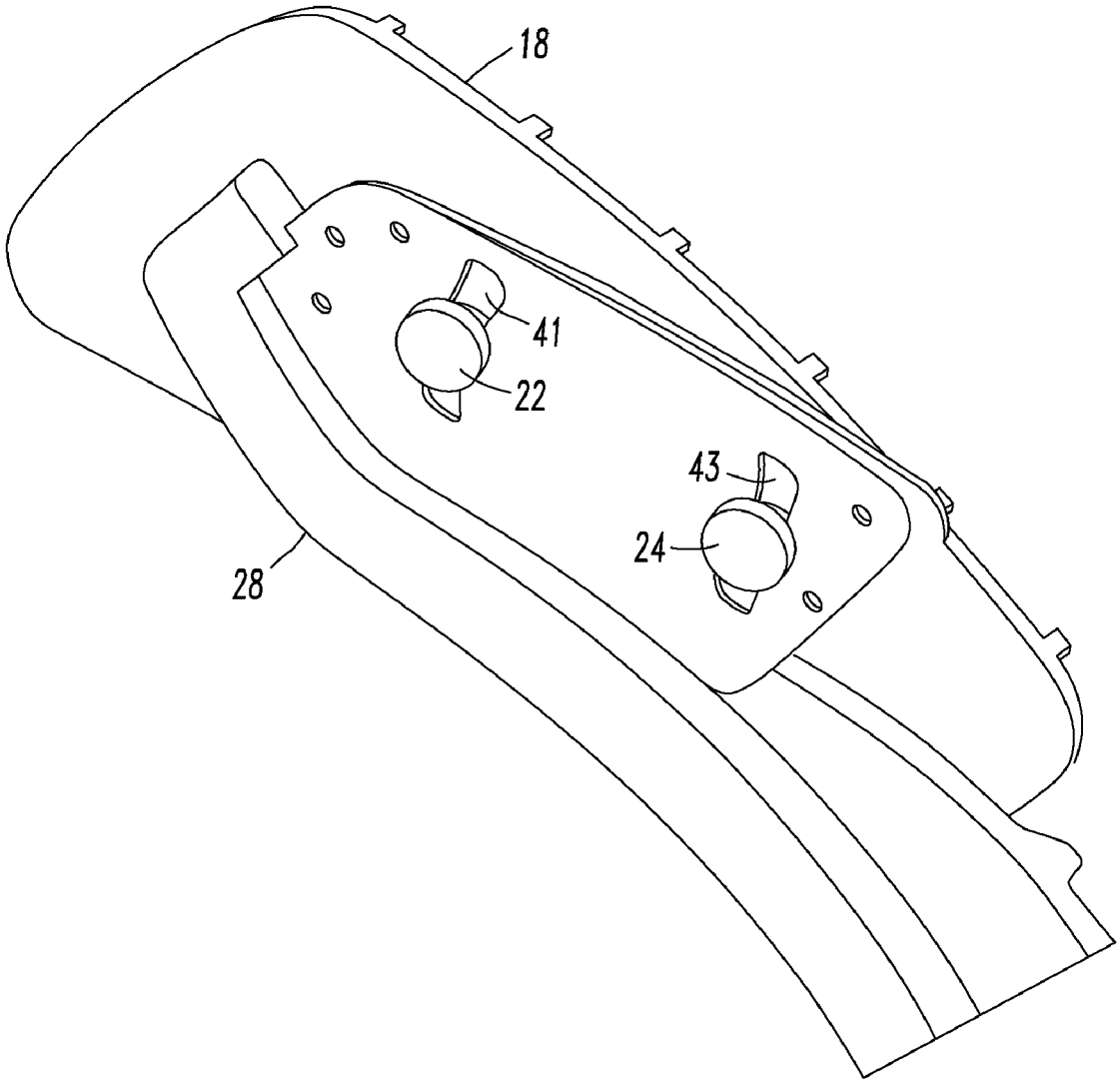
FIG. 20 is a fragmentary bottom view of the first present preferred embodiment with the armrest height adjustment actuator cut away.

As may best be appreciated in FIG. 20, the apertures 41 and 43 are curved. Aperture 41 has ends that are positioned rearward relative to a middle portion of the aperture 41. Aperture 43 has ends that are forward relative to a middle portion of the aperture 43. The configuration of the ends relative to the middle of each aperture defines the extent to which the arm pad 12 may be rotated relative to the armrest member 28.

Notches may be formed at intermediate positions adjacent the end portions of the apertures 41 and 43. The notches may be configured to require relatively more force exerted on a pin to pass along the notched area of the aperture than the non-notched areas of the aperture. For example, the notches may be configured to engage the pins as they move along the apertures such that the pins may be stopped or slowed when sliding along the notched portion of the aperture.

Various different rotatable paths may be defined by the length and curvatures of apertures 41 and 43. For example, one alternative embodiment can include an aperture 41 that has an inward end that is located forward of its middle portion and an outward end that is positioned rearward of its middle portion. Aperture 43 of such an embodiment may have an inward end that is located rearward of its middle portion and an outward end that is located forward of its middle portion.

As a second example, an aperture 41 can have an inward end that is located rearward of its middle portion and an outward end that is positioned forward of its middle portion. Aperture 43 of such an embodiment may have an inward end that is located rearward of its middle portion and an outward end that is located forward of its middle portion. Of course, other embodiments may have yet other configurations or include more than two apertures that are generally transverse to the slot 20. More than one forward and rearward extending slot, such as slot 20, may also be included in other embodiments of our armrest.

Figure 21:
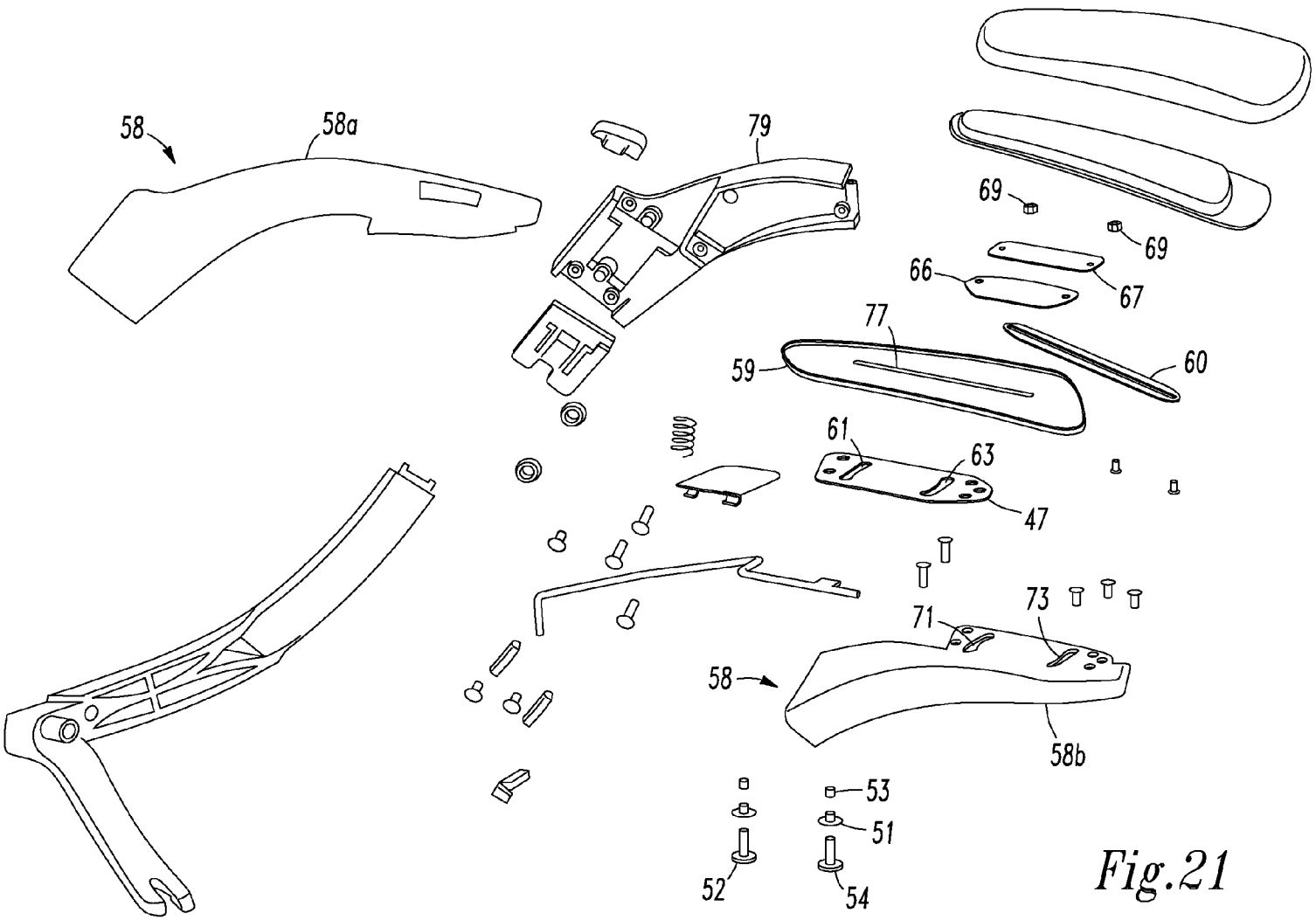
FIG. 21 is an exploded view of a second present preferred embodiment of our armrest.
Figure 21A:
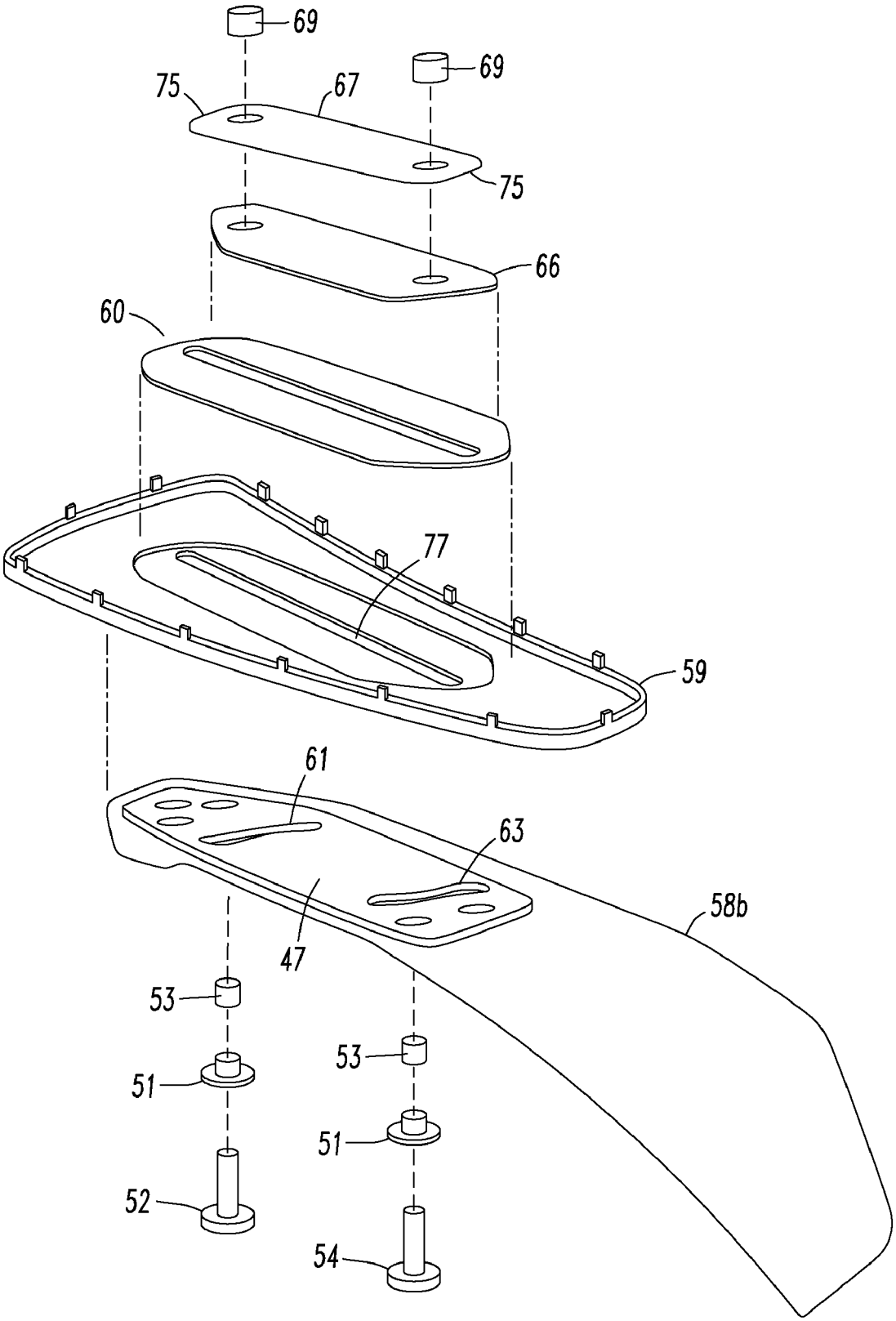
FIG. 21A is an exploded view of a portion of a second present preferred embodiment.
Figure 22:
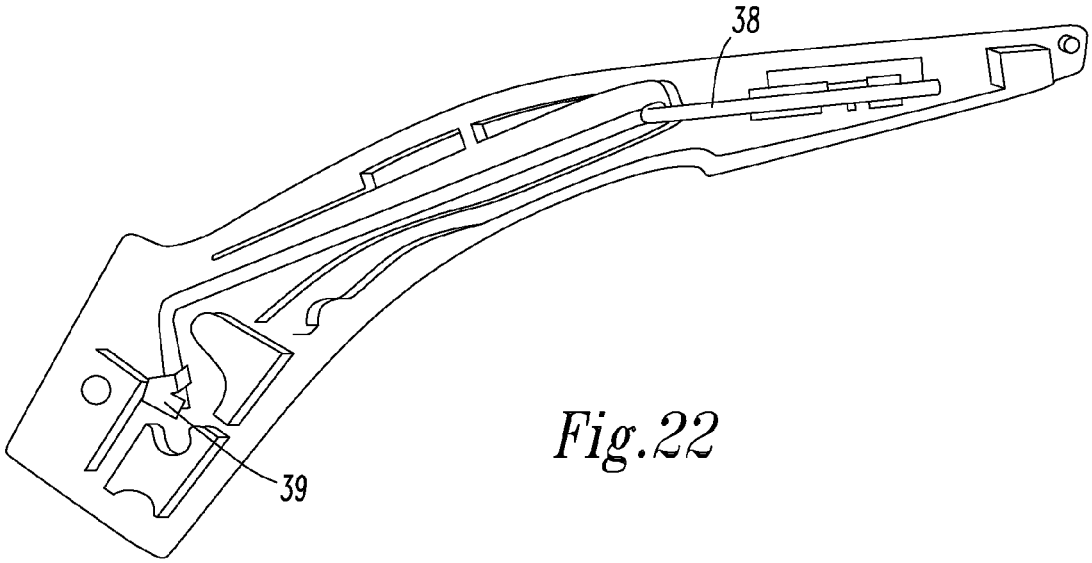
FIG. 22 is a fragmentary view of a first present preferred embodiment of an armrest height adjustment mechanism connected to a first present preferred embodiment of an armrest support.

As may be appreciated from viewing FIGS. 21 and 21A, the armrest member 58 may be composed of multiple portions 58*a* and 58*b* that are configured for attachment to each other. The armrest member 58 may also be configured to retain a carrier 79. It may also be desirable to provide a reinforcing plate 47 between an arm pad plate 59 and the armrest member 58 in some embodiments. The reinforcing plate 47 may be affixed to the armrest member 58 or otherwise attached to the armrest member 58. Depending on the thickness of the plate 47, the armrest member 58 need not define apertures for the pins. Instead, the reinforcing plate 47 may have apertures 61 and 63 that are sized and configured to receive the pins. The apertures 61 and 63 act similarly to the apertures 41 and 43 discussed above.

It is preferable, however, for the reinforcing plate 47 to be configured with apertures 61 and 63 that are aligned with the apertures 71 and 73 formed in the armrest member 58 when the reinforcing plate 47 is attached to the armrest member 58. The reinforcing plate 47, or wear plate, may permit the arm pad plate 59 to slide or move along portions of the armrest member 58 without scratching the armrest member 58 or otherwise deforming the upper surface of the armrest member 58 and may also reduce the amount of friction incurred from movement of the arm pad plate 59. Such features may be particularly advantageous when the armrest member 58 is composed of a material that is less hard than the plate 58. The reinforcing plate 47 may also be composed of a material that provides more or less friction than the armrest member 28 to adjust the ease of movability of the plate 59 and arm pad to ensure movement of the arm pad plate 59 occurs smoothly. Preferably, the reinforcing plate 47 is configured to have a friction property that permits a relatively low amount of friction to be incurred by sliding the arm pad plate 59 adjacent the armrest member portion 58*b*.

As shown in FIG. 21A, the arm pad plate 59 has an elongated slot 77 and is positioned above the armrest member portion 58*b* and reinforcing plate 47. A wear plate 60 that has a slot can also be provided adjacent the slot 77 to further support the arm pad plate 59. A threaded pin 52 extends through the aperture 61 and slot 77. A washer glide 51 is attached to the pin 52 and is positioned below a bumper 53. The bumper 53 is positioned on the pin 52 so that at least a portion of the bumper 53 is positioned within at least one of aperture 61, aperture 71 and slot 77. Preferably, the bumper is composed of thermoplastic elastomers, thermoplastic polyurethane elastomers or other rubbers or plastics. Pin 54 extends through aperture 61, aperture 71 and slot 77. A washer glide 51 is attached to the pin 54 and is positioned below a bumper 53. The bumper 53 is positioned on the pin 54 so that at least a portion of the bumper 53 is positioned within at least one of apertures 61 and 71 and slot 77. The washer glides 51 reduce friction that may act adjacent the bottom of the pins 52 and 54 when the pins are moved along the apertures or slot. The bumpers 53 help reduce the wear the armrest member portion 58*b*, reinforcing plate 47, arm pad plate 59 and/or wear plate 60 experience from movement of the pins 52 and 54.

The threaded pins 52 and 54 also extend through holes in a resilient body 66 and through tapped holes 75 in plate 67. The resilient body 66 may be, for example, a leaf spring, an elastomeric sheet, a plurality of interconnected elastomeric sheets or a plurality of interconnected leaf springs or compress springs. The tapped holes 75 are threaded such that the threaded pins 52 and 54 may be screwed through the tapped holes 75. A nut nylock 69 is screwed on to the top of each pin to lock the position of the pins relative to the tapped plate 67 and resilient body 66. The threads on the pins 52 and 54 and tapped holes 75 of the tapped plate 67 permit the sliding force necessary to move the arm pad plate 59 relative to the armrest member 58 and reinforcing plate 47 to be adjusted. The nut nylocks 69 permit the adjusted sliding force setting to be locked and/or readjusted, if necessary.

For example, the nut nylocks 69 may be positioned on the pins 52 and 54 to lock the location of the plate 67 and resilient body 66 along a portion of the threads of each pin at an initial position such that the plate 67 is in tight engagement with the resilient body 66. The initial position may reinforce the resilient body 66 to require a relatively substantial amount of force be provided by a user to move the pins 52 and 54. If this initial position is found to require too much sliding force for a particular user, the nut nylocks 69 and tapped plate 67 may be repositioned to loosen the fit between the resilient body 66 and plate 67 to reduce the sliding force needed to permit movement of the armrest plate 59. Of course, the nut nylocks 69 and plate 67 may also be moved to increase the amount of sliding force needed to move the arm pad plate 59 by tightening the engagement of the plate 67 against the resilient body 66. Preferably, plate 67 is relatively rigid and composed of metal.

The armrest apparatus 10 is configured to be vertically adjustable relative to the seat 2. An armrest height adjustment mechanism 37 is attached to the armrest member 28 and armrest support 11 to permit such vertical adjustment, as may be appreciated from FIGS. 22 through 27. The armrest height adjustment mechanism includes an actuator 35 attached to the armrest member 28 and a lock pin 39 connected to the actuator 35. An elongated member 38 preferably attaches the actuator 35 to the lock pin 39. The elongated member 38 may be a cable, a chain, a particularly shaped rod or bar, or other member sized and configured to attach the actuator to the lock pin 39. The elongated member 38 extends through a portion of the armrest member 28 to attach the actuator 35 to the lock pin 39. Preferably, this portion of the elongated member 38 is within the armrest member 28 so that it cannot be seen by a user and does not detract from the aesthetic effect of the armrest apparatus. In some embodiments, this hidden portion of the elongated member 38 may be the entirety of the elongated member 38.

Preferably, the actuator 35 includes a flexible member adjacent the elongated member 38 such that the flexible member engages the elongated member 38 and attaches the actuator to the elongated member 38. The flexible member may be integral with the actuator such that the flexible member and actuator form a unitary structure. Of course, the flexible member may alternatively be a separate resilient member that is attached to the actuator between the elongated member 38 and the actuator 35. The flexible member may be, for example, a leaf spring or other resilient body. It should be appreciated that the flexible member permits the actuator to absorb tolerance set offs between the manufactured actuator component and elongated member component. This flexibility also reduces the likelihood that the elongated member 38 or actuator 35 may break or otherwise be damaged if excessive force is used to actuate the actuator 35 or otherwise move the actuator 35 or elongated member 38.

Figure 23:
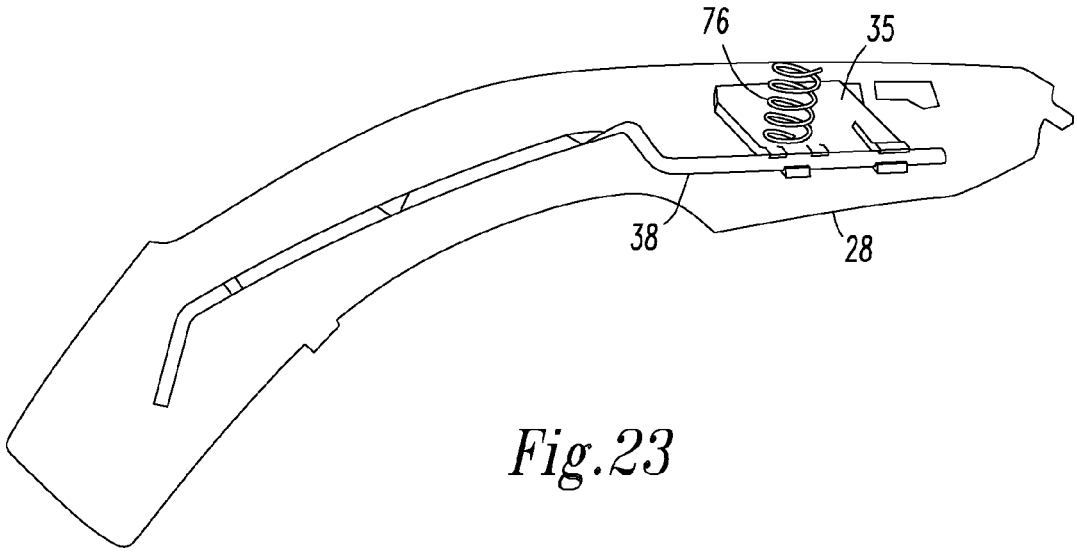
FIG. 23 is a fragmentary view of a first present preferred embodiment of an armrest height adjustment mechanism.
Figure 24:
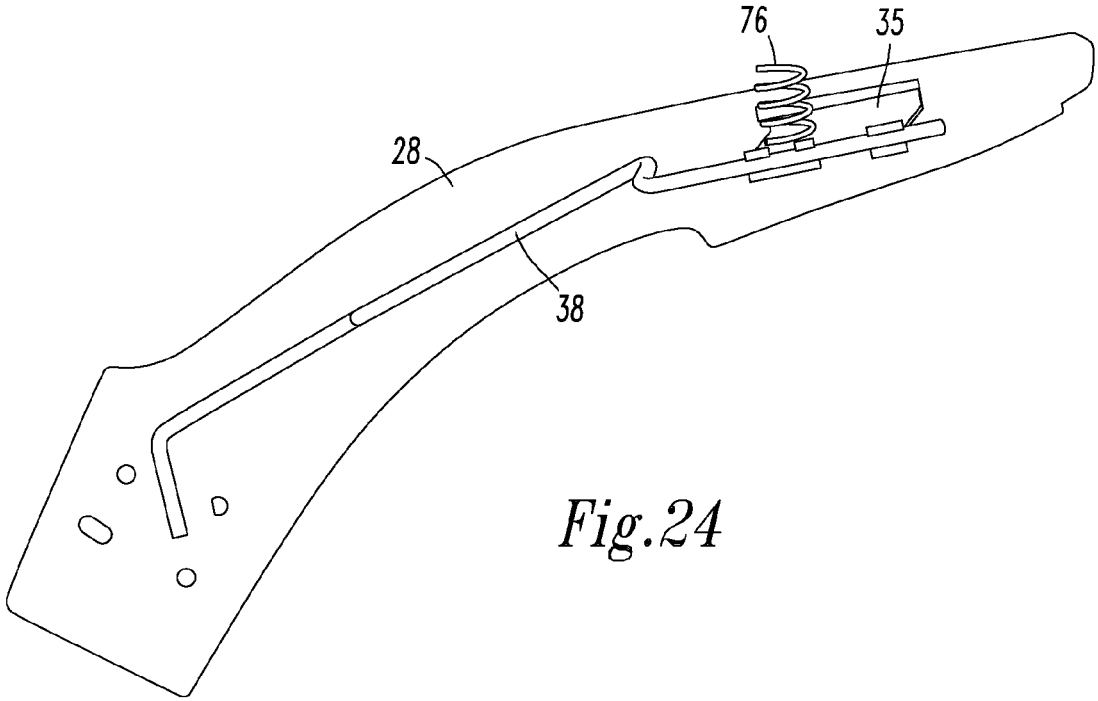
FIG. 24 is a fragmentary view of a first present preferred embodiment of an armrest height adjustment mechanism.
Figure 25:
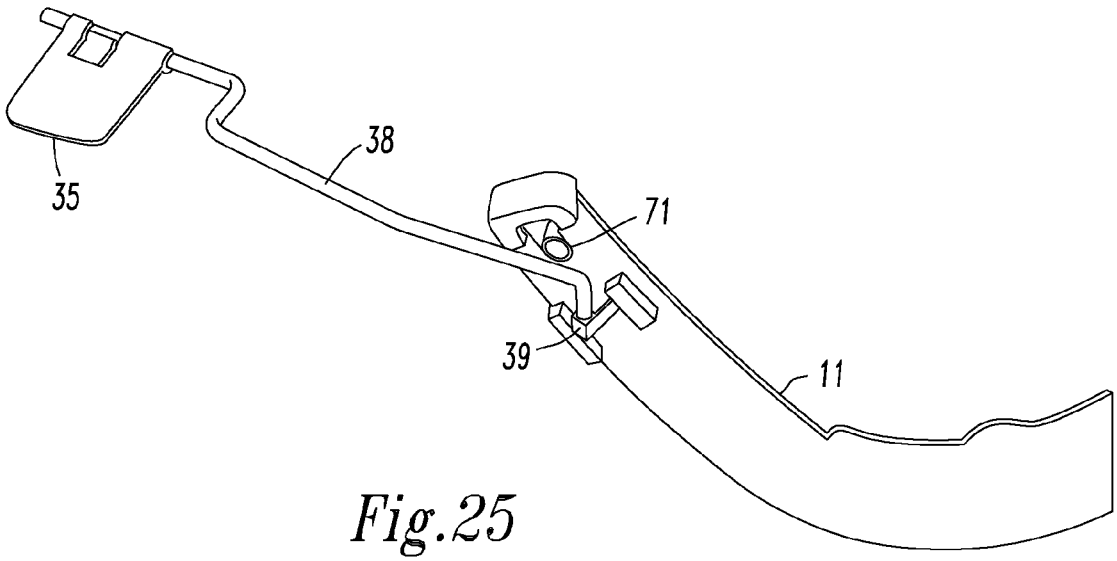
FIG. 25 is a fragmentary view of a first present preferred embodiment of an armrest height adjustment mechanism connected to a first present preferred embodiment of an armrest support.
Figure 26:
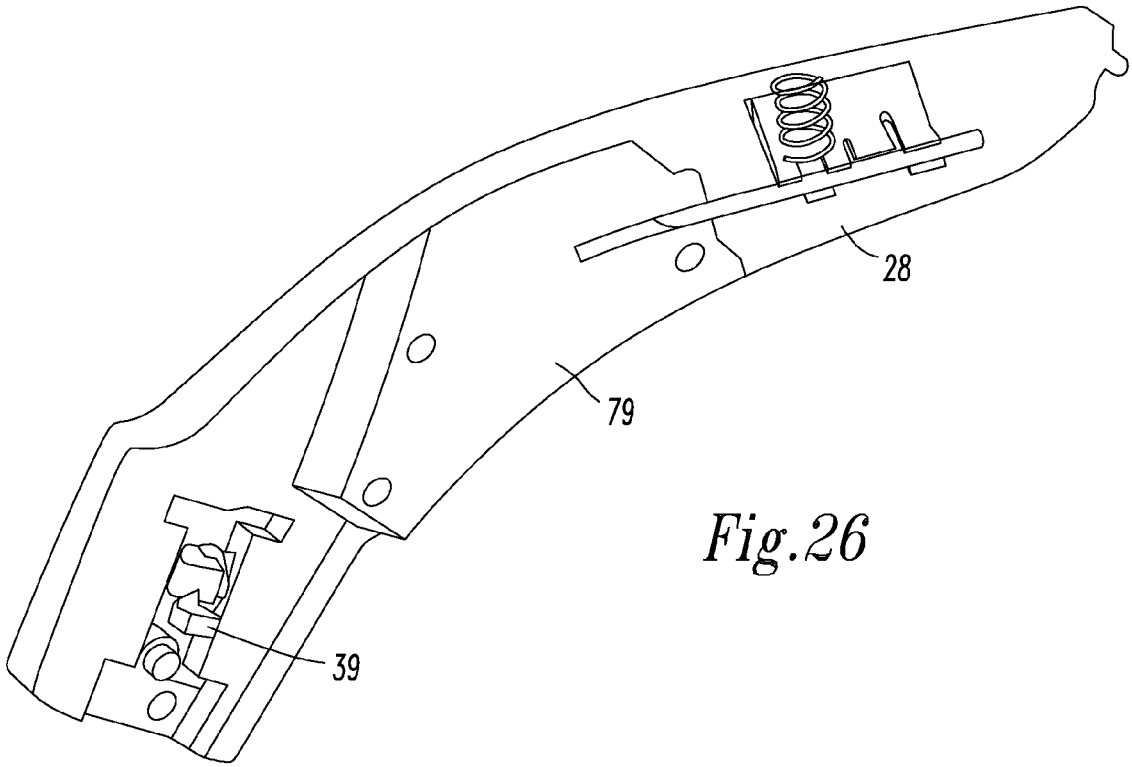
FIG. 26 is a fragmentary view of a first present preferred embodiment of an armrest height adjustment mechanism illustrating a carrier attached to a portion of an armrest member.
Figure 27:
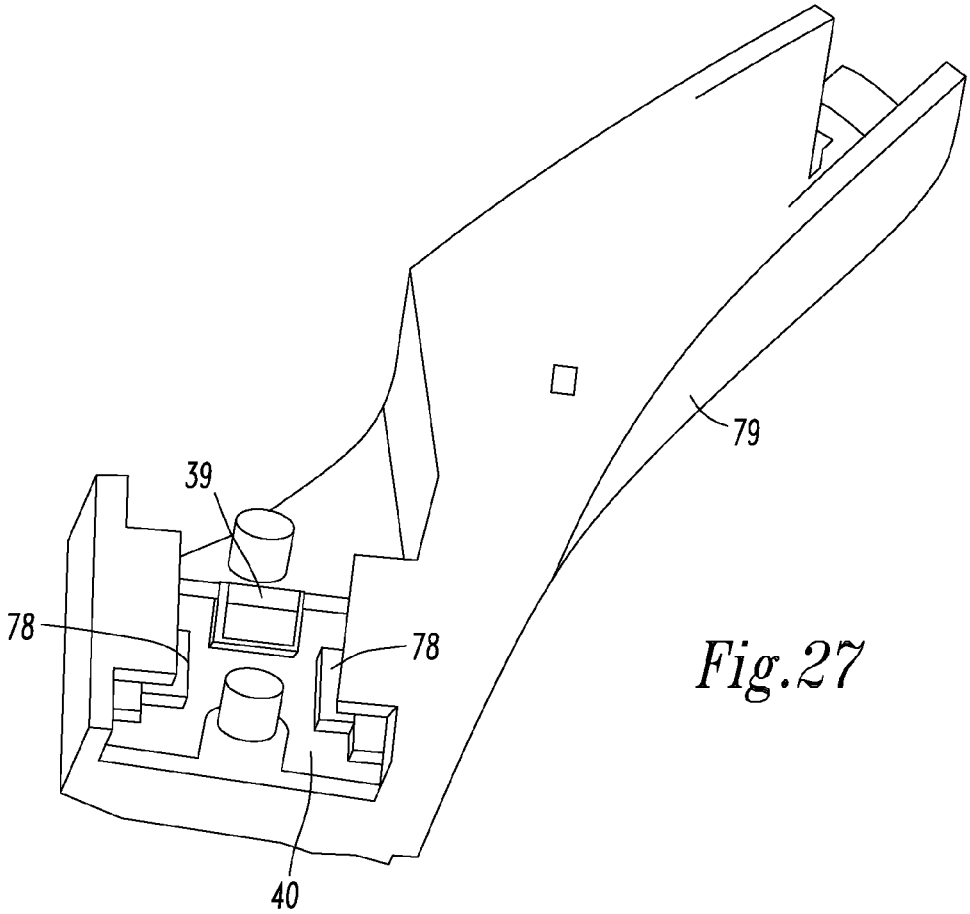
FIG. 27 is a perspective view of a present preferred carrier.

The lock pin 39 extends through a portion of the armrest member 28 adjacent opening 30 such that the lock pin 39 can be removably positioned within a hole 71 formed in the armrest support 11 as may be appreciated from FIG. 23. The actuator 35 may be pressed downward by a user to cause the lock pin to be moved out of one hole 71 so that the armrest member 28 can be moved along the armrest support 11 to a new position. When a user releases the actuator 35, the lock pin is configured to move back into a hole 71 in the armrest support to lock the new position of the armrest member 28 and arm pad 12.

Figure 4:
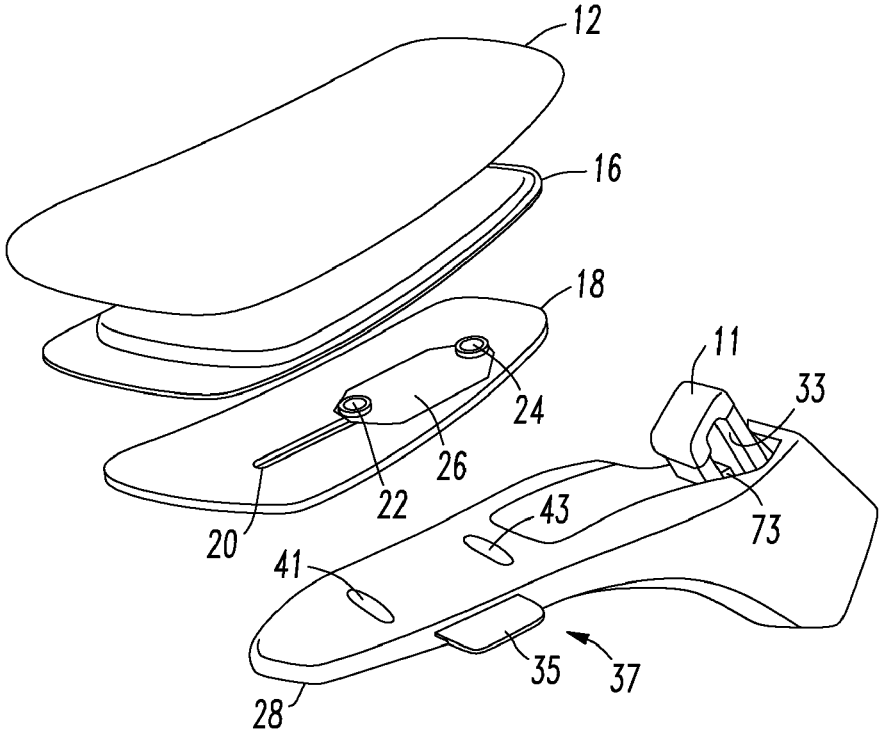
FIG. 4 is an exploded fragmentary view of the first present preferred embodiment.
Figure 5:
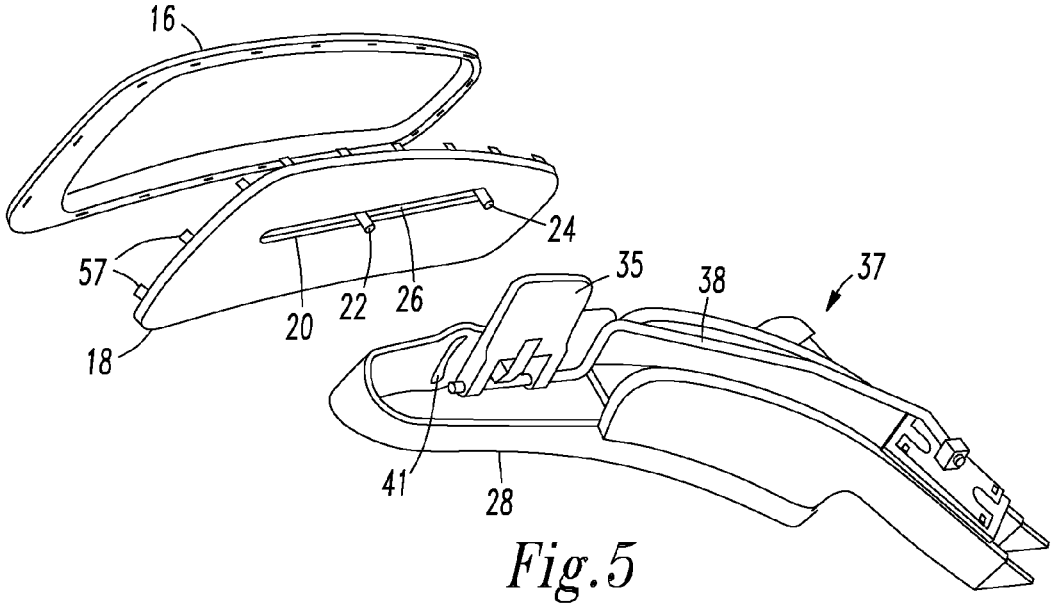
FIG. 5 is an exploded fragmentary view of the first present preferred embodiment.
Figure 6:
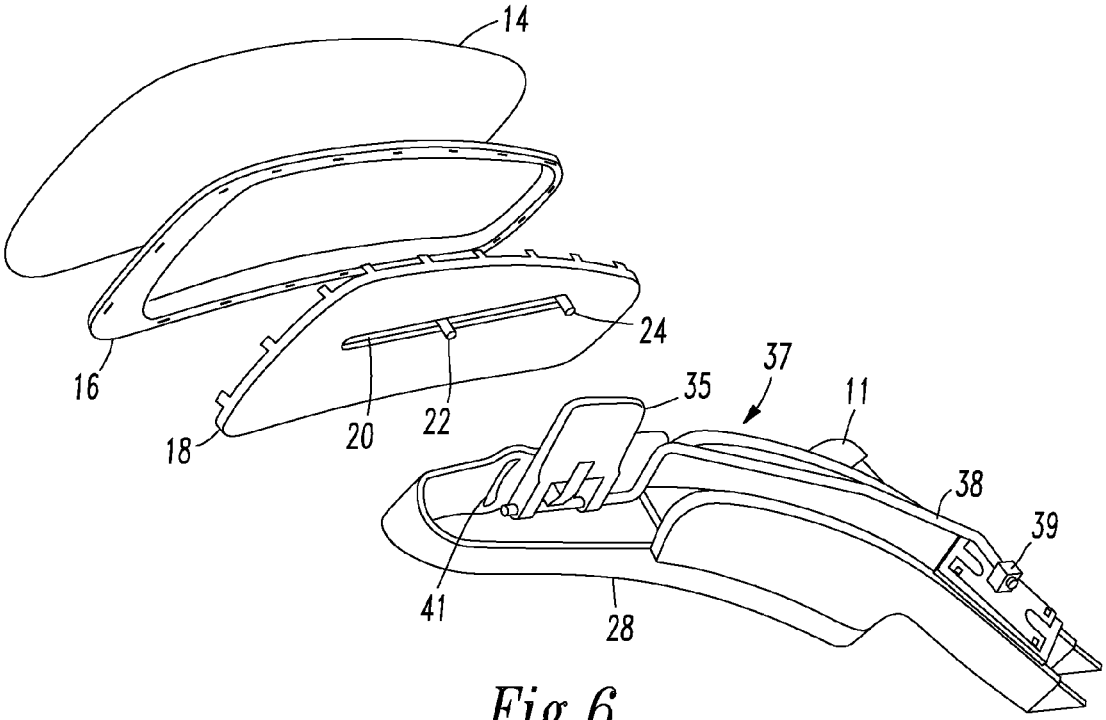
FIG. 6 is an exploded fragmentary view of the first present preferred embodiment.
Figure 7:
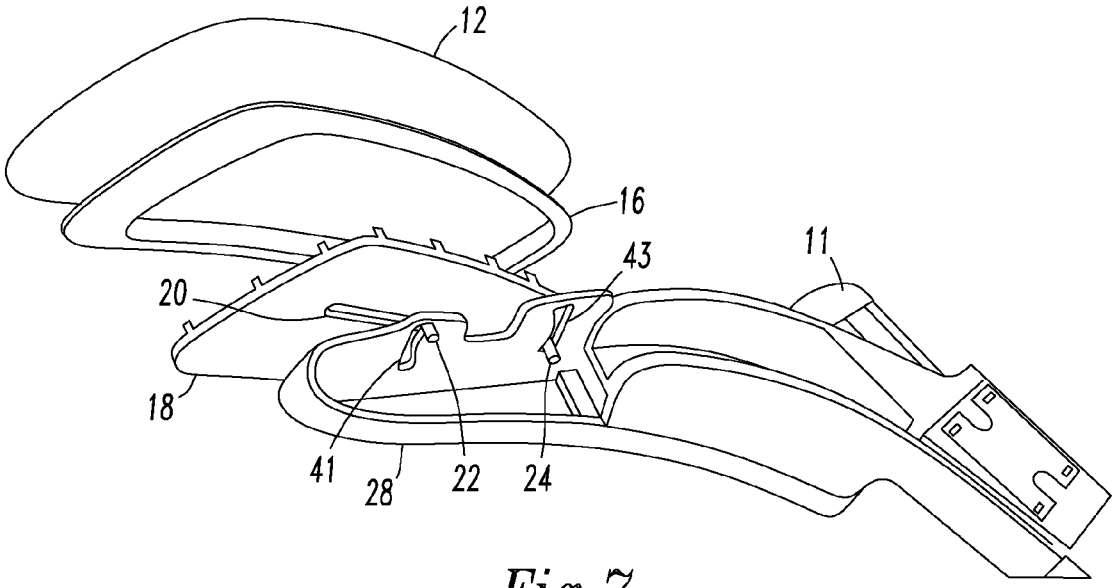
FIG. 7 is an exploded fragmentary view of the first present preferred embodiment.
Figure 9:
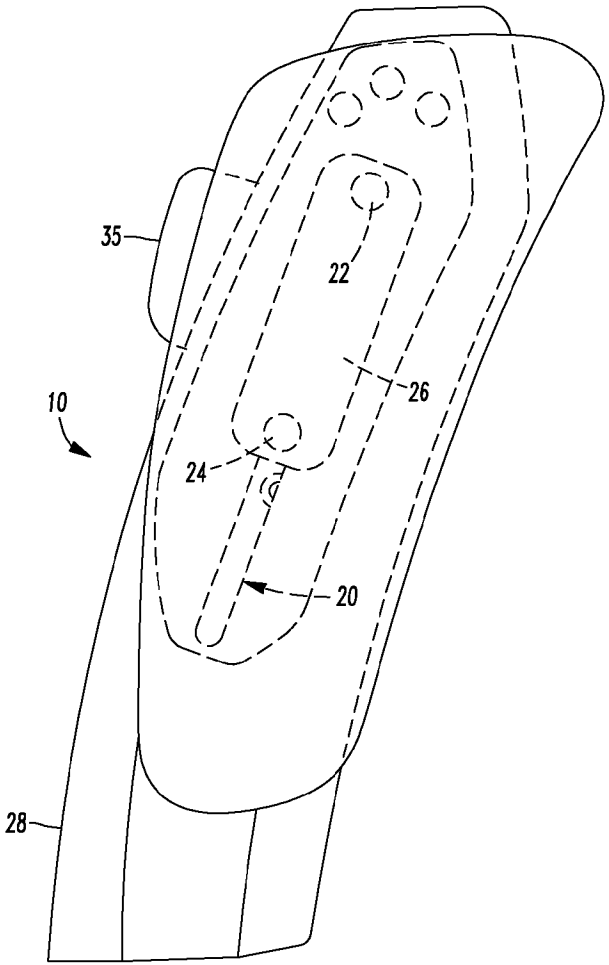
FIG. 9 is a fragmentary view similar to FIG. 8 with the arm pad cut away.
Figure 8:
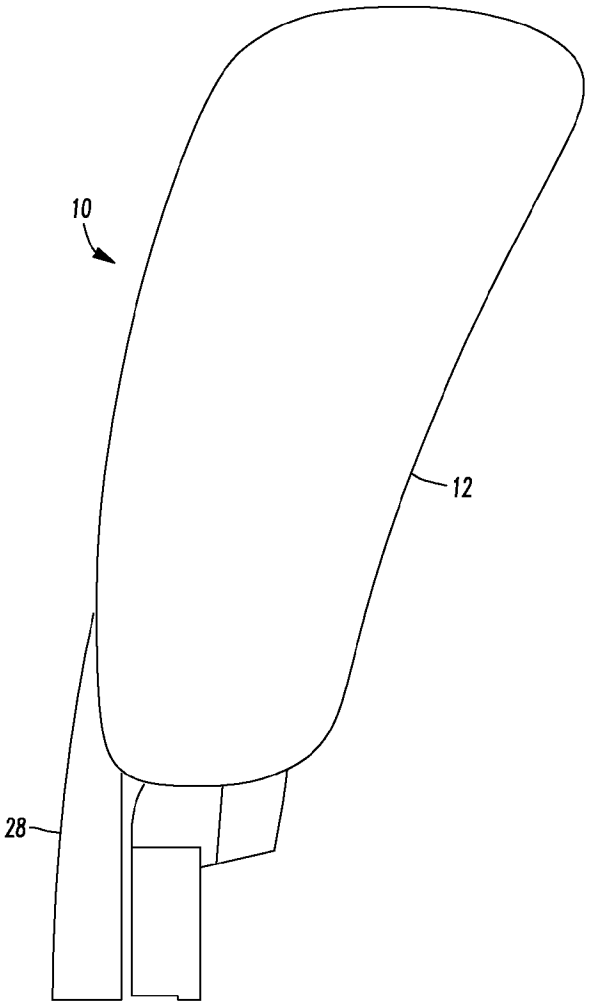
FIG. 8 is a fragmentary view of the first present preferred embodiment illustrating the arm pad in a rear most position.
Figure 11:
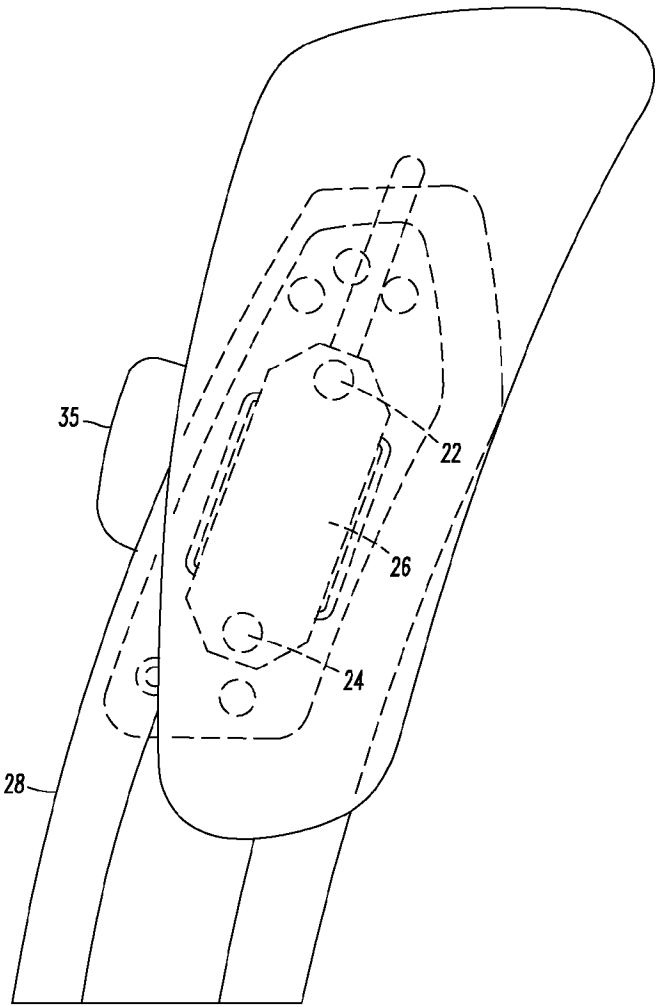
FIG. 11 is a fragmentary view similar to FIG. 10 with the arm pad cut away.
Figure 10:
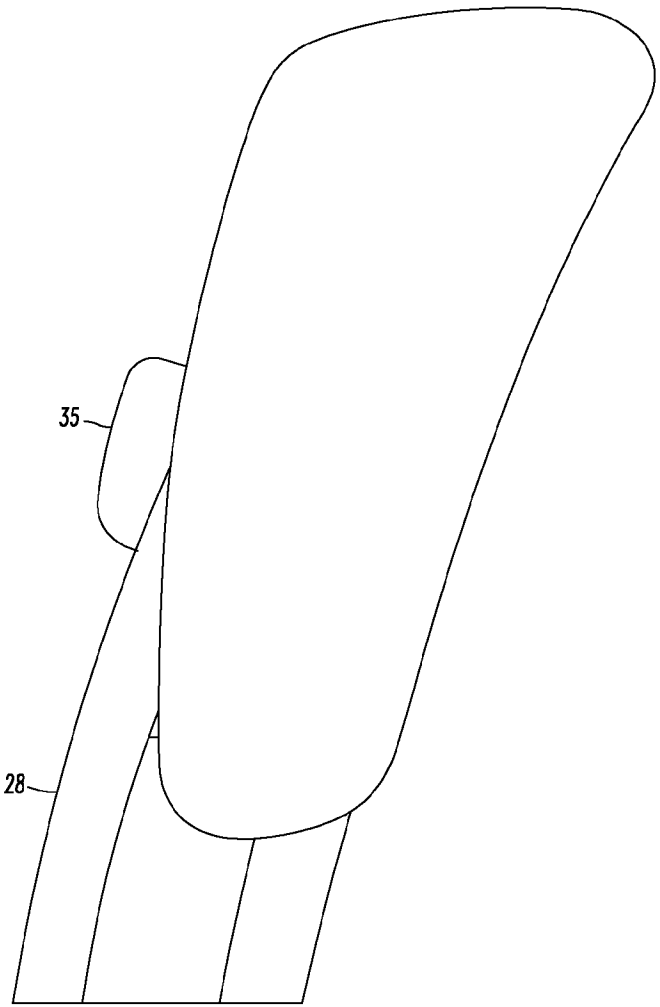
FIG. 10 is a fragmentary view of the first present preferred embodiment illustrating the arm pad in a forward position.
Figure 13:
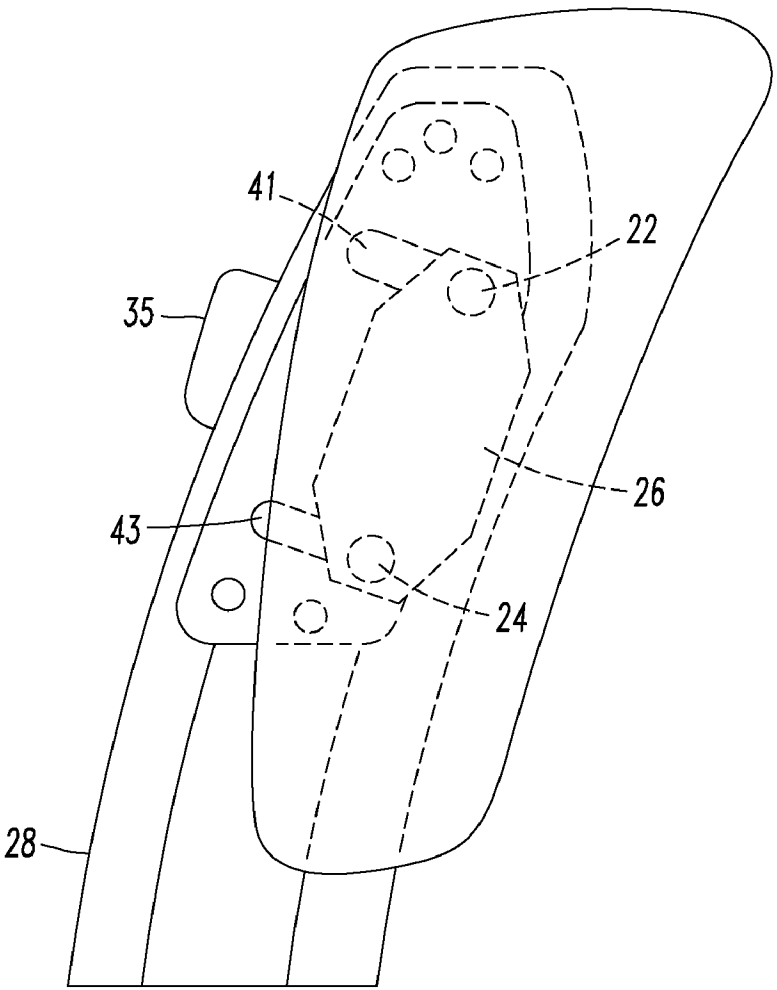
FIG. 13 is a fragmentary view similar to FIG. 12 with the arm pad cut away.
Figure 12:
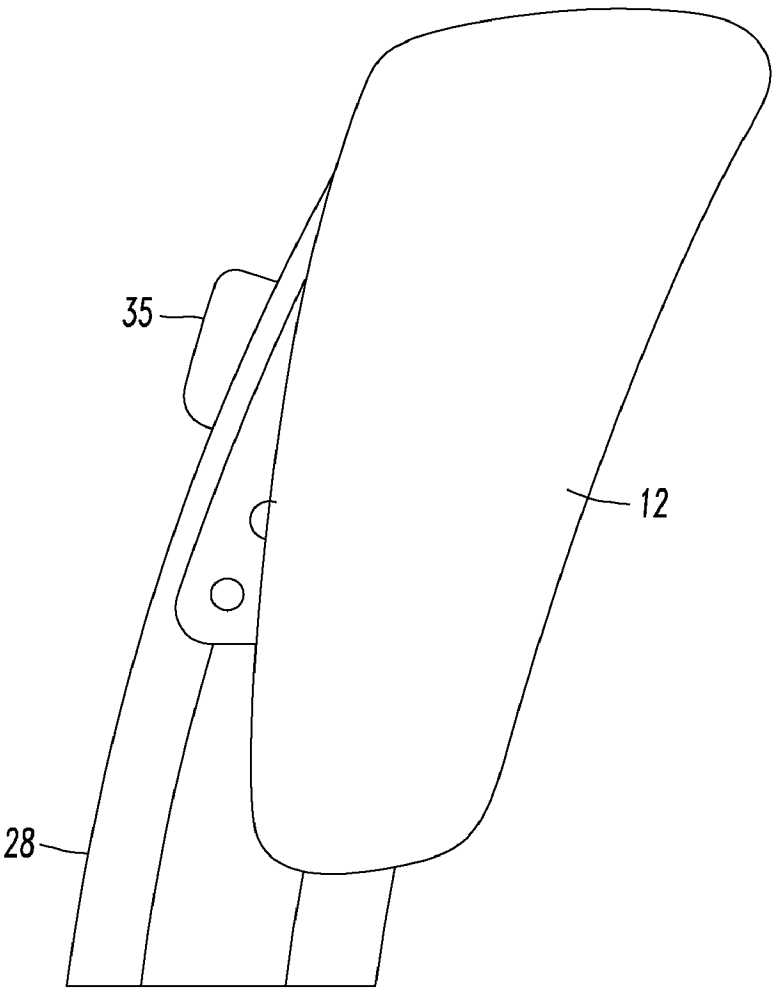
FIG. 12 is a fragmentary view of the first present preferred embodiment illustrating the arm pad in an inward position.
Figure 15:
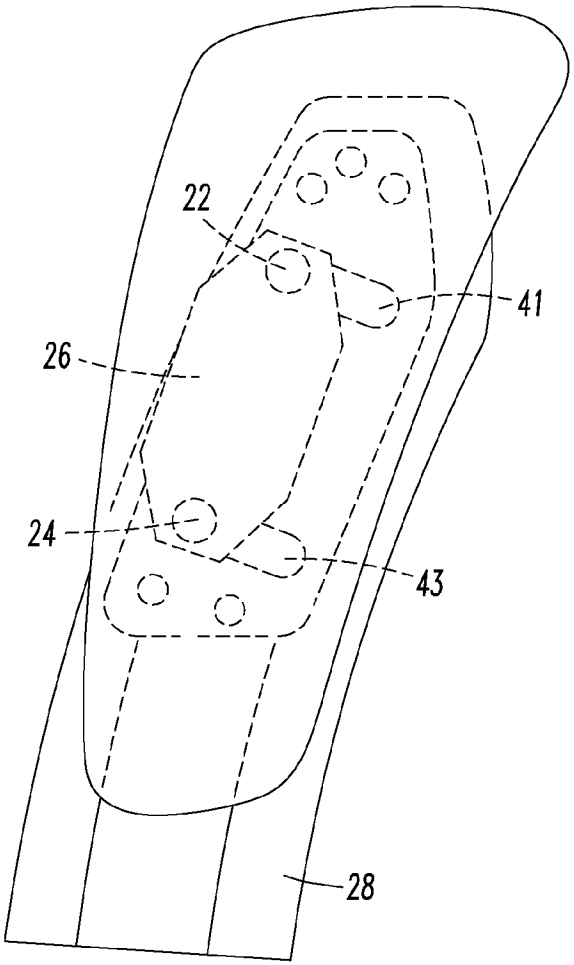
FIG. 15 is a fragmentary view similar to FIG. 14 with the arm pad cut away.
Figure 14:
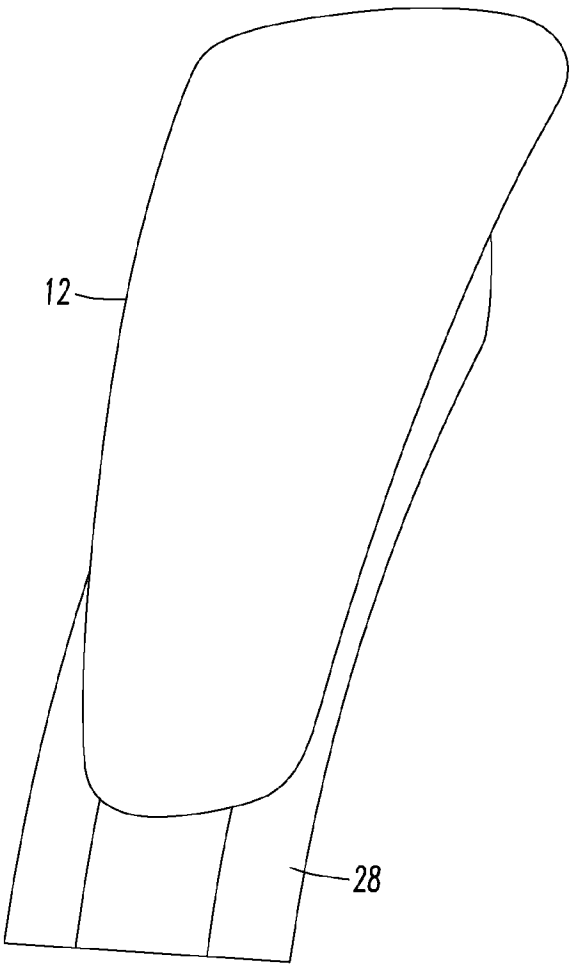
FIG. 14 is a fragmentary view of the first present preferred embodiment illustrating the arm pad in an outward position.
Figure 17:
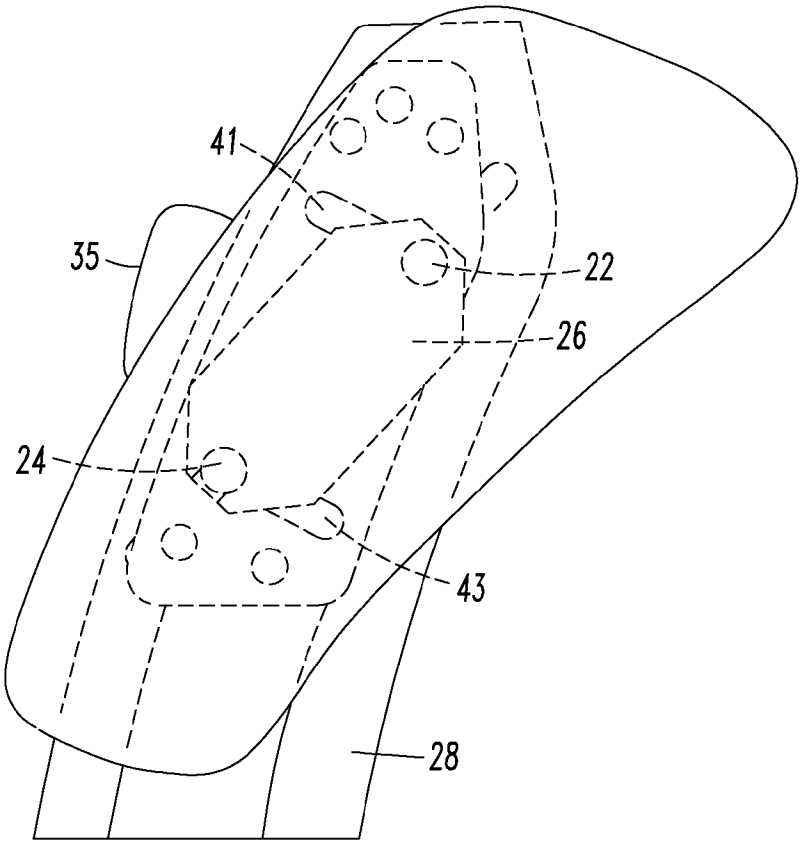
FIG. 17 is a fragmentary view similar to FIG. 16 with the arm pad cut away.
Figure 16:
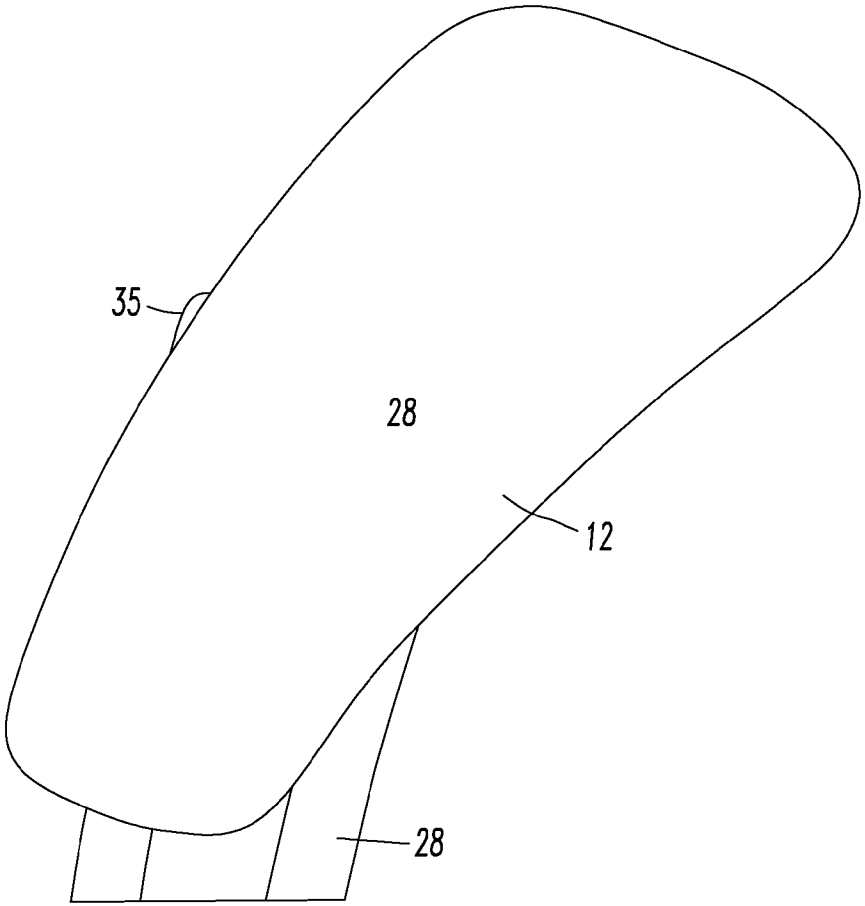
FIG. 16 is a fragmentary view illustrating the arm pad in a first rotated position.
Figure 19:
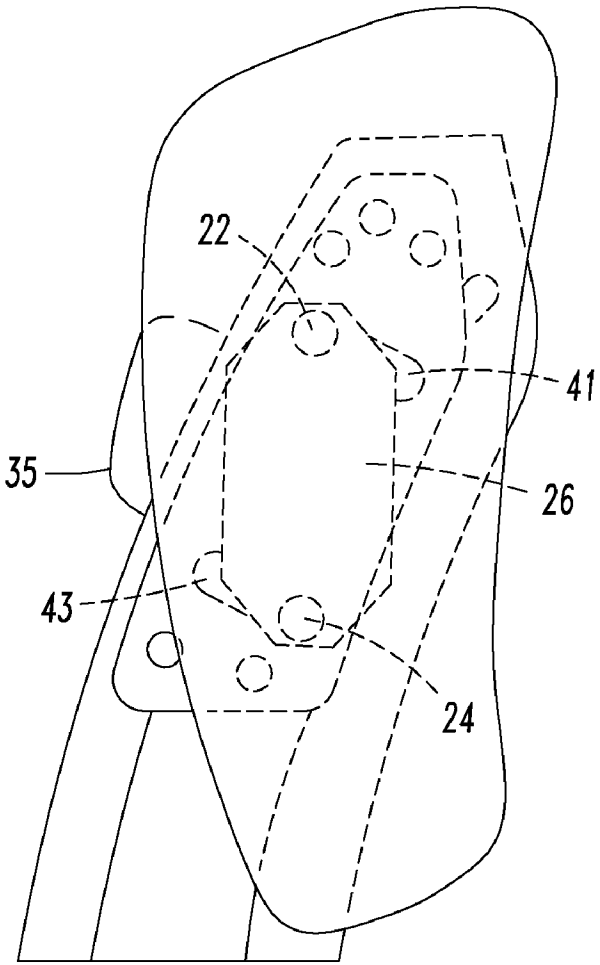
FIG. 19 is a fragmentary view similar to FIG. 16 with the arm pad cut away.
Figure 18:
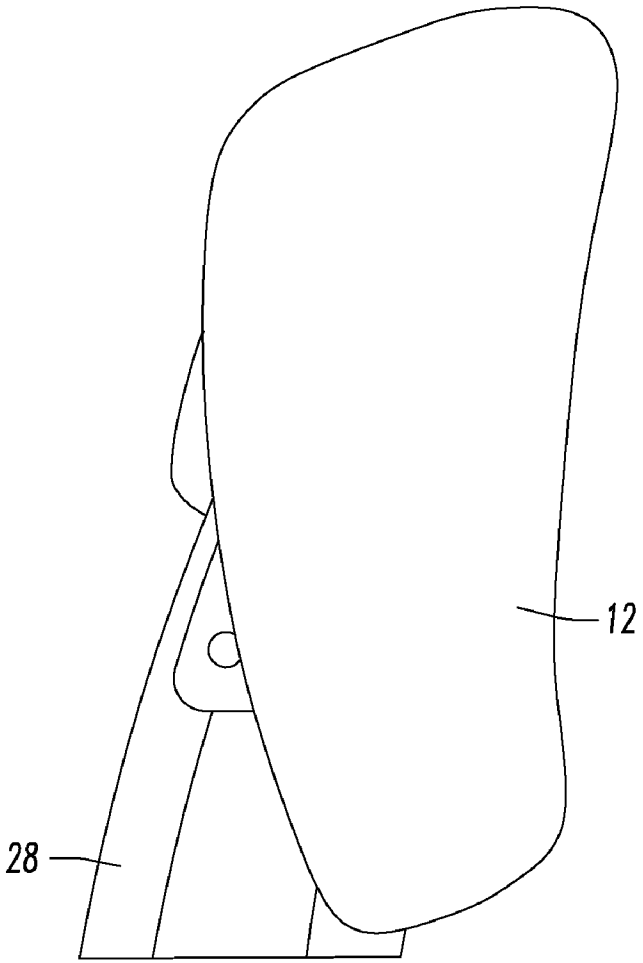
FIG. 18 is a fragmentary view illustrating the arm pad in a second rotated position.

In alternative embodiments, the lock pin 39 can be configured to be removably positioned between teeth 73 formed in the armrest support 11, as may be appreciated from FIG. 4. The teeth 73 are located within a channel 33 formed in the armrest support member 11. Preferably, the gap is sized to permit a portion of the armrest member 28 to be positioned between the armrest support 11 and the back frame 5 and move along a portion of the armrest support 11. Actuation of the actuator 35 causes the lock pin 39 to move out of engagement with the teeth 73 so that the armrest member 28 may be moved along the armrest support 11 to a different position.

Figure 28:
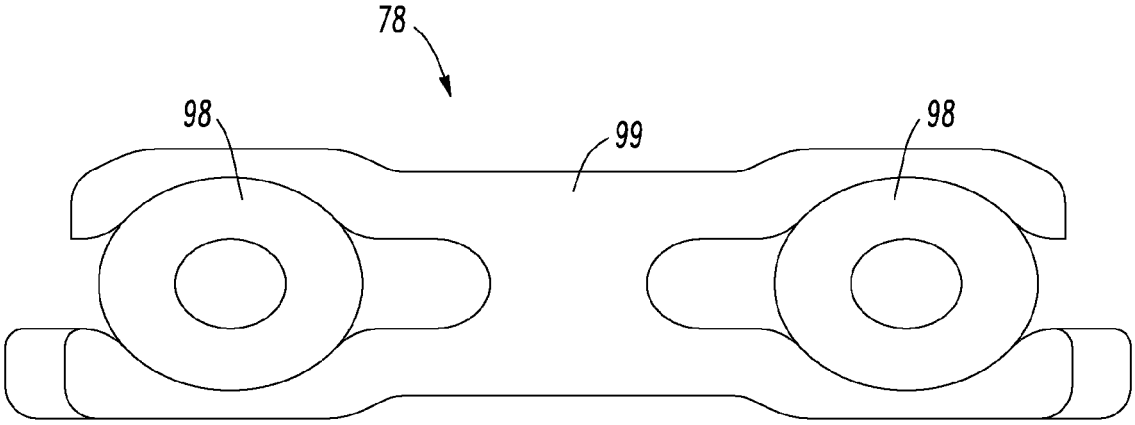
FIG. 28 is a top view of a present preferred bearing.

The lock pin 39 extends through the armrest member 28 and a carrier 79. The lock pin 39 is adjacent a liner 40, which is disposed between the lock pin 39 and bearings 78. The carrier is configured to engage a portion of the armrest support 11 and slide along the armrest support 11 when the armrest member 28 is being vertically adjusted. Each bearing 78 preferably includes elastomeric springs 98 assembled in a casing 99, as shown in FIG. 28. The casing 99 is preferably composed of a relatively low friction material that is also preferably a polymeric material or an elastomeric material. The casing 99 and elastomeric springs 98 are configured to exert pressure between the armrest support 11 portions to help keep the portions tightly interconnected.

The lock pin 39 is moveable inward, toward the armrest support 11, and outward, away from the armrest support 11. The spring 76 acts on the elongated member 38 to bias the lock pin 39 in an inward position to lock the vertical position of the armrest member 28. When the actuator 35 is actuated, the elongated member is moved to adjust the lock pin to an outward position such that the armrest member 28 may be moveable to a higher or lower vertical position along the armrest support 11. Preferably, the carrier 79 is composed of a material that does not induce a lot of friction against the armrest support 11 when the armrest member 28 is vertically adjusted.

In one embodiment, the actuator 35 is configured to be lifted by a user to cause the lock pin 39 to move to permit vertical adjustment of the armrest member 28. The actuator 35 may be biased downward to lock the position of the armrest member 28 by one or more coil springs 76 or other resilient bodies. A user may move the actuator 35 upwards to compress the spring 76 or other resilient bodies to permit movement of the lock pin 39 so that the armrest member 28 can be vertically adjusted. After a user releases the actuator, the spring or other resilient body causes the actuator 35 to move downward, which locks the position of the armrest member 28.

It should be appreciated that the actuator 35 can be configured to actuate the armrest height adjustment mechanism in various other ways. For example, the actuator may be configured to move inward and outward relative to the armrest member 28. As yet another example, the actuator could be configured to be moved downward to permit height adjustment of the arm pad 12 and be biased to an upward position by a spring or other resilient body.

Preferably, the armrest supports 11 are configured to be attached to the bottom of the back frame 5 at one end and extend adjacent to and along a side of the back frame 5 as may best be appreciated in FIG. 2. Such a configuration preferably has a gap between the side of the back frame 5 and the armrest support 11. Such armrest support members provide a noticeable and desirable aesthetic affect that permits the armrest apparatuses to provide a desired aesthetic effect to the overall appearance of the chair 1. One configuration of the preferred armrest supports 11, which may best be seen in FIG. 2, are generally L-shaped members. Each generally L-shaped member has a lower curved portion 81 of the generally L-shaped member extending inward toward the back frame 5 and downward toward the bottom of the back frame 5 relative to the upper stem portion 82 of the generally L-shaped member.

In other embodiments each armrest support 11 may be a generally J-shaped member that has its lower curved portion curved inward and downward relative to its upper stem portion. In yet another embodiment, both armrest supports 11 shown in FIGS. 1 and 2 could be sized and configured as portions of a unitary structure that forms a generally U-shaped member that has stem portions on each side of the back frame integral with a respective curved portion that is curved inward and downward as it extends to the bottom center portion of the generally U-shaped body. Preferably, the armrest support 11 is composed of metal, such as aluminum or steel and the armrest member 28 is composed of plastic.

We also prefer that the armrest member 28 and the armrest support 11 be configured to provide a curved support surface that extends from adjacent the arm pad 12 to adjacent the back frame 5 and is also vertically spaced from the seat 2. Such a curved surface permits the armrest support member 28 to provide support to a user's back or other body part in the event a user chooses to sit in the chair in a sideward fashion. Such side sitting occurs, for example, when a user places his/her legs under or over the arm pad 12 and armrest member 28 on one side of the chair such that one side of the user is facing the back 3 and the back of the user is facing the other armrest member 28 and arm pad 12. It should be understood that such side sitting can be accommodated by the preferred armrest supports 11 illustrated in FIGS. 1 and 2 in combination with the preferred armrest members 28 and armrest pads 12.

It should be appreciated that other variations of the present preferred embodiments discussed above may be made. For example, embodiments of our armrest apparatus can include frictional inducing components operatively connected to each arm pad to require increased force by a user to cause the arm pads to be moved. As another example, the arm pads may include a cushion attached to a portion of the outer surface of the arm pads to better support a portion of a user's body. As yet another example, embodiments of our armrest apparatus may be supported on a back frame side member or on supports that are attached to a seat or chair base.

While certain present preferred embodiments of our armrest apparatus and chair and certain embodiments of methods of practicing the same have been shown and described, it is to be distinctly understood that the invention is not limited thereto but may be otherwise variously embodied and practiced within the scope of the following claims.

What is claimed is:

1. A chair comprising:

a base;

a seat attached to the base;

a back attached to at least one of the seat and the base; and at least one armrest apparatus attached to at least one of the back, the seat and the base, each of the at least one armrest apparatus comprising:

an armrest member attached to at least one of the back, the seat and the base, the armrest member having a first aperture and a second aperture, at least a portion of the first aperture being substantially parallel to at least a portion of the second aperture a first plate positioned above the armrest member, the first plate having a longitudinal slot that is transverse to the first and second apertures, an armrest cover attached to the first plate, a resilient device positioned between the first plate and the armrest cover or between the first plate and the armrest member;

a first member extending through the first aperture and the longitudinal slot of the first plate; and a second member extending at least partially through the second aperture and the longitudinal slot of the first plate;

the resilient device being comprised of a resilient body positioned above a tapped plate, the resilient body having a first hole and a second hole and the tapped plate having a first hole aligned with the first hole of the resilient body and a second hole aligned with the second hole of the resilient body, the first member extending through the first hole of the resilient body and extending through the first hole of the tapped plate and the second member extending through the second hole of the resilient body and extending through the second hole of the tapped plate; and the first member being adjustably positioned within the first hole of the tapped plate and the first hole of the resilient body such that the first member is adjustable to loosen or tighten positioning of the resilient body relative to the tapped plate and wherein the second member being adjustably positioned within the second hole of the tapped plate and the second hole of the resilient body such that the second member is adjustable to loosen or tighten positioning of the resilient body relative to the tapped plate; and wherein adjustment of the positioning of at least one of the first member and the second member to adjustably loosen or tighten positioning of the resilient body relative to the tapped plate adjusts an amount of force needed to move or slide the first plate relative to the armrest member.

2. The chair of claim 1 wherein the resilient body is a leaf spring or an elastomeric sheet, the tapped plate is positioned above the first plate, and both the first member and the second member are adjustably positioned to adjustably loosen or tighten the positioning of the resilient body relative to the tapped plate.

3. The chair of claim 2 wherein the resilient device is also comprised of a first nut and a second nut, the first nut positioned above the resilient body and the tapped plate, the first nut receiving a portion of the first member, the second nut positioned above resilient body and the tapped plate and the second nut receiving a portion of the second member.

4. The chair of claim 3 wherein the armrest cover is comprised of an armrest pad attached to a second plate, the second plate being attached to the first plate and wherein the first nut is a nut nylock and the second nut is a nut nylock and wherein the resilient device is positioned between the first plate and the second plate.

5. The chair of claim 1 further comprising at least one support member attached to a bottom portion of the back of the chair, the at least one support member extending from the bottom portion of the back of the chair to a position adjacent the seat, the armrest member of the at least one armrest apparatus being moveably attached to the at least one support member, and wherein a portion of the first member and a portion of the second member are positioned below the armrest member.

6. The chair of claim 5 wherein the seat has a front, a rear, a first side between the front and rear and a second side between the front and rear that is opposite the first side, the at least one support member is comprised of a first support member and a second support member and the at least one armrest apparatus is comprised of a first armrest and a second armrest, wherein the first support member extends from a bottom portion of the back frame to a position adjacent the first side of the seat and the second support member extends from a bottom portion of the back frame to a position adjacent the second side of the seat and wherein the armrest member of the first armrest is moveably attached to the first support member and the armrest member of the second armrest is moveably attached to the second support member.

7. The chair of claim 6 wherein the first support member is a generally L-shaped member or a generally J-shaped member and wherein the second support member is a generally L-shaped member or a generally J-shaped member.

8. The chair of claim 6 wherein the first support member and the second support member are portions of a generally U-shaped support.

9. The chair of claim 5 wherein each of the at least one support member has a channel and a plurality of holes or teeth defined in the channel.

10. The chair of claim 1 wherein the at least one armrest apparatus does not have a locking device that is moveable from a locked position that locks the lateral and rotational position of the armrest cover and an unlocked position in which the armrest cover is at least one of laterally moveable and rotationally moveable.

11. The chair of claim 1 wherein the first plate and the armrest cover are attached together by a snap fit attachment mechanism, interference fit attachment mechanism, or a combination thereof.

12. The chair of claim 1 wherein the first member is a pin or a screw and the second member is a pin or a screw.

13. The chair of claim 1 further comprising at least one washer guide or at least one bumper attached to the first member and at least one washer guide or at least one bumper attached to the second member.

14. The chair of claim 1 further comprising a wear plate attached to the first plate such that the wear plate is positioned for engagement with an upper surface portion of the armrest member.

15. The chair of claim 1 wherein the at least one armrest apparatus is configured such that the resilient device and the first plate are configured for substantially lateral movement along a first path defined by the first and second apertures and the first plate is configured for movement along a second path defined by the longitudinal slot for longitudinal movement.

16. The chair of claim 15 wherein the first path also defines rotational movement and does not permit substantial longitudinal movement of the resilient device.

17. The chair of claim 1 wherein the armrest apparatus further comprising an actuation device attached to the armrest member, the actuation device comprising an actuator member configured for movement between a first position and a second position, a biasing mechanism that is sized and configured to bias the actuator member to the first position, and an elongated member that is attached to the actuator member such that the elongated member moves when the actuator member moves from the first position to the second position.

18. The chair of claim 17 wherein the elongated member is positioned within the armrest member and has a first end and a second end and the armrest apparatus is further comprised of an engagement member, the engagement member attached to the first end of the elongated member and the actuator member attached to the second end of the elongated member, the engagement member attached to the elongated member such that the engagement member retracts within the armrest member when the actuator member is moved from the first position to the second position.

19. The chair of claim 1 wherein the armrest apparatus does not have a locking device that is moveable from a locked position that locks the lateral and rotational position of the armrest cover and an unlocked position wherein the armrest cover is at least one of laterally moveable and rotationally moveable.

20. An armrest apparatus sized and configured for attachment to at least one chair component comprising:

an armrest member having a first aperture and a second aperture, the armrest member sized and configured for attachment to the at least one chair component;

a first plate positioned above the armrest member, the first plate having a longitudinal slot;

an armrest cover attached to the first plate;

a resilient device positioned between the first plate and the armrest cover or between the first plate and the armrest member, the resilient device having a first hole and a second hole;

a first member extending through the first aperture and the longitudinal slot of the first plate; and a second member extending through the second aperture and the longitudinal slot;

the resilient device being comprised of a resilient body positioned above a tapped plate, the resilient body having a first hole and a second hole and the tapped plate having a first hole aligned with the first hole of the resilient body and a second hole aligned with the second hole of the resilient body, the first member extending through the first hole of the resilient body and extending at least partially through the first hole of the tapped plate and the second member extending through the second hole of the resilient body and extending at least partially through the second hole of the tapped plate; and the first member being adjustably positioned within the first hole of the tapped plate and the first hole of the resilient body such that the first member is adjustable to loosen or tighten positioning of the resilient body relative to the tapped plate and wherein the second member being adjustably positioned within the second hole of the tapped plate and the second hole of the resilient body such that the second member is adjustable to loosen or tighten positioning of the resilient body relative to the tapped plate; and wherein adjustment of the position of at least one of the first member and the second member to adjustably loosen or tighten positioning of the resilient body relative to the tapped plate adjusts an amount of force needed to move or slide the first plate relative to the armrest member.

21. The armrest apparatus of claim 20 wherein the resilient body is a leaf spring or an elastomeric sheet, the tapped plate is positioned above the first plate, and wherein the resilient device is also comprised of a first nut and a second nut, the first nut positioned above the resilient body and the tapped plate, the first nut receiving a portion of the first member, the second nut positioned above the resilient body and the tapped plate and the second nut receiving a portion of the second member.

22. The armrest apparatus of claim 21 wherein both the first member and the second member are adjustably positioned to adjustably loosen or tighten the positioning of the resilient body relative to the tapped plate and wherein the tapped plate is threaded adjacent the first hole of the tapped plate and the tapped plate is threaded adjacent the second hole of the tapped plate and wherein the first member is threaded such that threads of the first member mate with threads of the tapped plate adjacent the first hole of the tapped plate and the second member is threaded such that threads of the second member mate with threads formed adjacent the second hole of the tapped plate and wherein rotation of at least one of the first member and second member adjustably loosens or tightens positioning of the resilient body relative to the tapped plate.

23. The armrest apparatus of claim 22 wherein the armrest cover is comprised of an armrest pad attached to a second plate, the second plate being attached to the first plate and wherein the resilient device is positioned between the first plate and the second plate.

24. The armrest apparatus of claim 23 wherein the armrest apparatus is configured such that the resilient device and the first plate are configured for substantially lateral movement along a first path defined by the first and second apertures and the first plate is configured for movement along a second path defined by the longitudinal slot for longitudinal movement.

25. The armrest apparatus of claim 24 wherein the first path also defines rotational movement and does not permit substantial longitudinal movement of the resilient device.

* * * * *